US009859073B2

(12) United States Patent
Maggiore

(10) Patent No.: US 9,859,073 B2
(45) Date of Patent: Jan. 2, 2018

(54) TACTILE BUTTON DEVICE, TACTILE BUTTON ASSEMBLY AND SINGLE-USE PRODUCT

(71) Applicant: Sartorius Stedim Biotech GmbH, Goettingen (DE)

(72) Inventor: Frank Maggiore, Port Jefferson Station, NY (US)

(73) Assignee: SARTORIUS STEDIM BIOTECH GMBH, Goettingen (DE)

( * ) Notice: Subject to any disclaimer, the term of this patent is extended or adjusted under 35 U.S.C. 154(b) by 456 days.

(21) Appl. No.: 14/607,454

(22) Filed: Jan. 28, 2015

(65) Prior Publication Data

US 2016/0217946 A1 Jul. 28, 2016

(51) Int. Cl.

| | |
|---|---|
| ***H01H 13/85*** | (2006.01) |
| ***H01H 13/14*** | (2006.01) |
| ***H01H 3/24*** | (2006.01) |
| ***H01H 35/24*** | (2006.01) |

(52) U.S. Cl.

CPC ..... *H01H 13/85* (2013.01); *H01H 3/24* (2013.01); *H01H 13/14* (2013.01); *H01H 35/24* (2013.01); *H01H 2217/00* (2013.01)

(58) Field of Classification Search

CPC ..... H01H 3/24; H01H 35/24; H01H 2217/00; H01H 13/14; H01H 13/85

USPC ..... 200/5 A, 51 R, 5 R, 341, 345; 600/500, 600/300; 606/1

See application file for complete search history.

(56) References Cited

U.S. PATENT DOCUMENTS

| | | | | |
|---|---|---|---|---|
| 2,838,629 A * | 6/1958 | Panzenhagen | ..... | H01H 3/24 200/243 |
| 6,765,158 B1 * | 7/2004 | Morrison | ..... | H01H 13/70 200/341 |

* cited by examiner

*Primary Examiner* — Edwin A Leon
(74) *Attorney, Agent, or Firm* — Gerald E. Hespos; Michael J. Porco; Matthew T. Hespos

(57) ABSTRACT

A tactile button device is provided and is suitable to be sterilized. The tactile button device has at least one receptacle that is adapted to be filled at least partly with a material and further is configured so that the material filled into the receptacle is displaced when subjected to a pressure. At least one duct is connected to the receptacle and allows the pressure exerted to the material to be transmitted. A connector is connected to the at least one duct and is connectable to a detection device so that the pressure on the material is transmitted to the detection device.

23 Claims, 16 Drawing Sheets

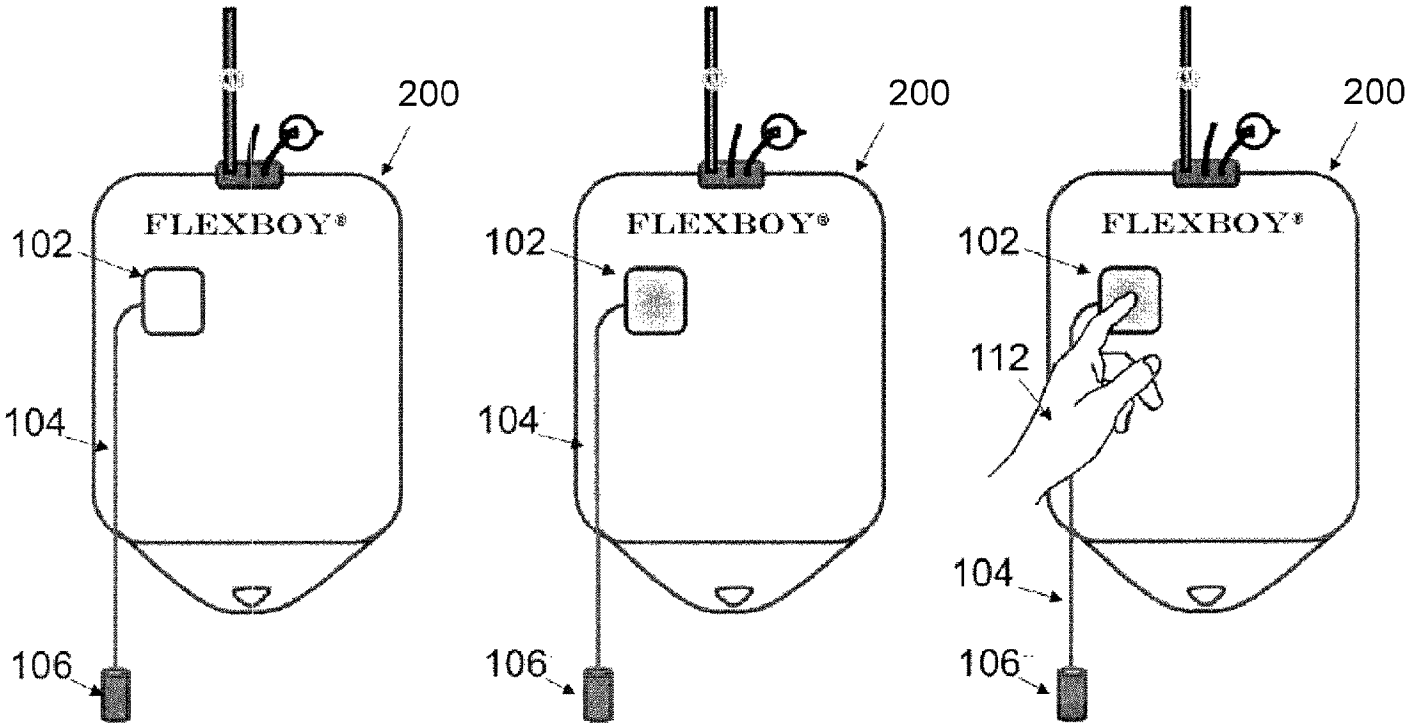
Fig. 7A
Fig. 7B
Fig. 7C
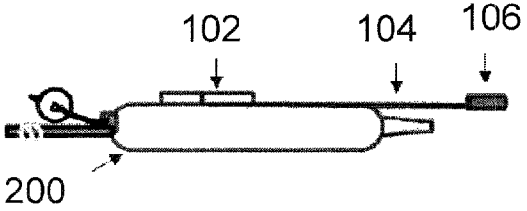
Fig. 7D

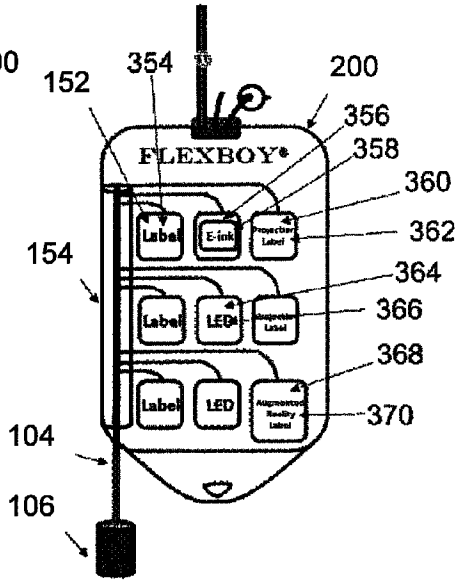
Fig. 9E
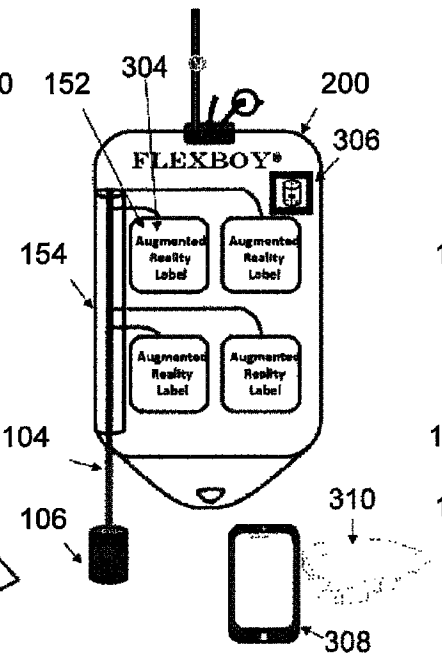
Fig. 9F
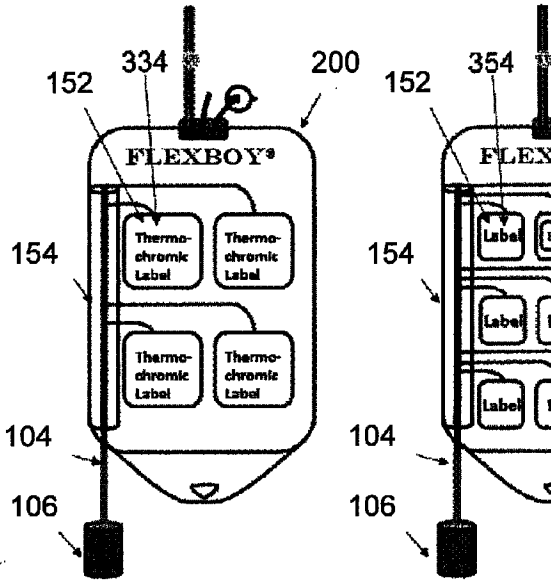
Fig. 9G
Fig. 9H

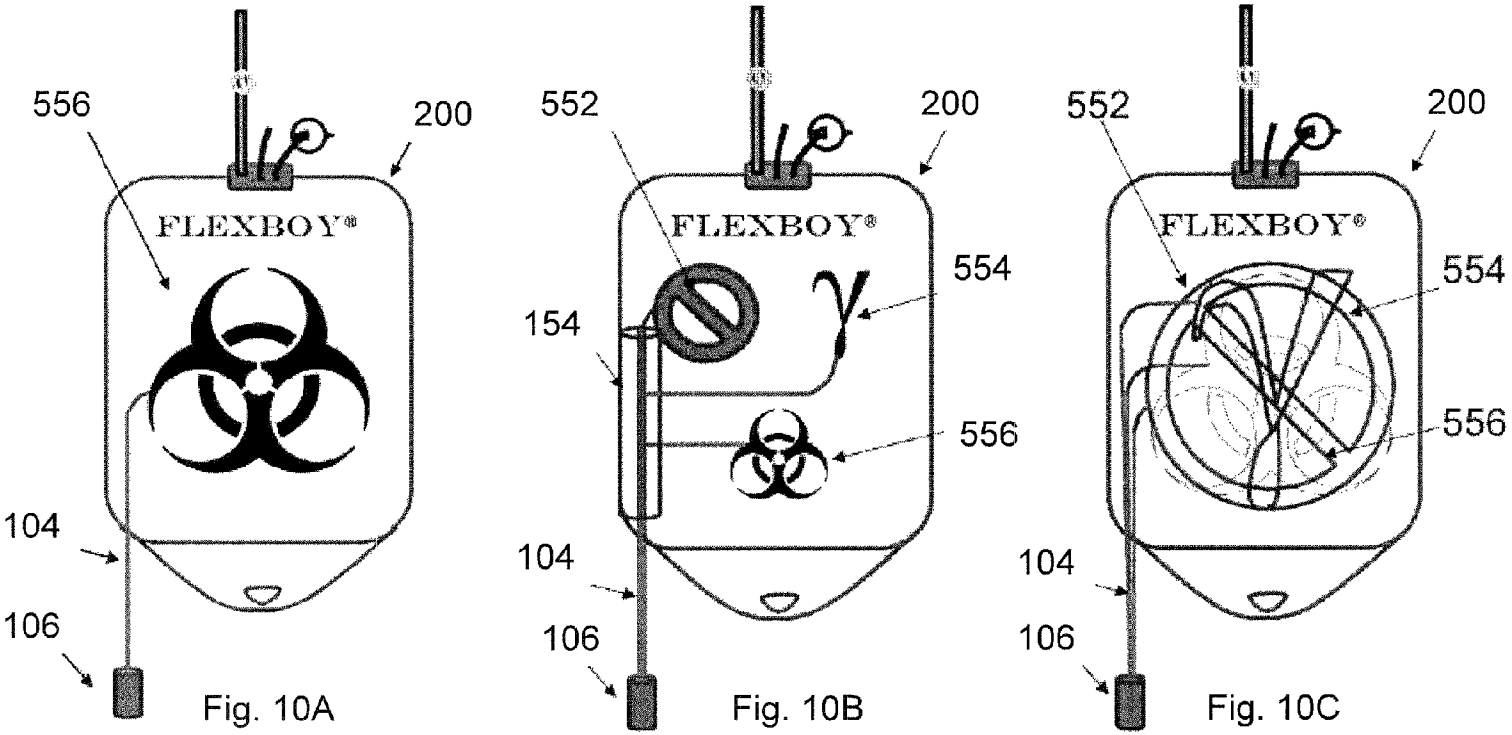
Fig. 10A
Fig. 10B
Fig. 10C
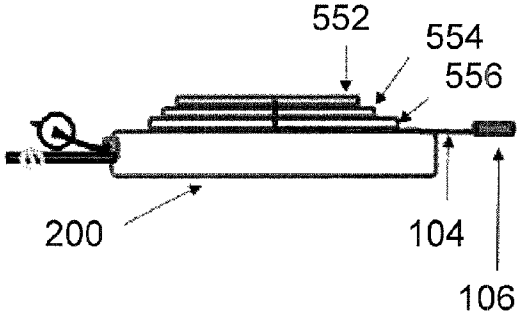
Fig. 10D

TACTILE BUTTON DEVICE, TACTILE BUTTON ASSEMBLY AND SINGLE-USE PRODUCT

BACKGROUND

The application relates to a sterilizable tactile button device for use in combination with an external item such as a consumable component and/or a process device, as well as a tactile button assembly and a single-use product provided therewith.

A tactile button device may be a device for controlling some aspects, information display, and/or functions of an apparatus and/or of a process, wherein the tactile button device may be depressed in order to initiate the controlling. In most cases, the controlling is achieved by means of electronic components.

For example, a consumable component may be a bioprocess filter and a process device may be an integrity test unit. A bioprocess filter necessitates sterilization in order to be usable. Similarly, if the control panel of an integrity test unit is touched by e.g. soiled gloves, a sterilization process may be needed.

The sensitive electronic components used for the controlling require shielding to resist gamma irradiation, autoclaving or other sterilization procedures. It becomes therefore cumbersome to ensure sterile conditions for items that comprise such controlling means.

SUMMARY

According to one aspect, a tactile button device suitable to be sterilized is provided. The tactile button device comprises the following:

at least one receptacle that is adapted to be at least partly filled with a material and being configured such that the material filled into the receptacle is at least partly displaced when subjected to a pressure, at least one duct connected to the receptacle and allowing the pressure exerted to the material to be transmitted, a connector connected to the at least one duct and connectable to a detection device, such that the pressure on the material is transmitted to the detection device.

According to another aspect, a tactile button assembly is provided. The tactile button assembly comprises the following:

at least one tactile button device according to the above aspect, a mating connector connected to the connector of the tactile button device, a detection device connected to the tactile button device via the mating connector, wherein the detection device is configured to detect the transmitted pressure on the material in the at least one filled receptacle.

According to a further aspect, a single-use product suitable to be sterilized is provided. The single-use product comprises the following:

at least one tactile button device according to the above aspect, and a consumable component, wherein the at least one tactile button device is attached to or integrally formed into the consumable component.

BRIEF DESCRIPTION OF THE DRAWINGS

Details of exemplary embodiments are set forth below with reference to the exemplary drawings. Other features will be apparent from the description, the drawings, and from the claims.

FIGS. 7A to 7D show an example of a tactile button device on a consumable component.

FIGS. 9A to 9H show examples of a tactile button device comprising a plurality of label-differentiated receptacles on a consumable component.

FIGS. 10A to 10D show examples of a tactile button device with receptacles adapted for the display of information on a consumable component.

DETAILED DESCRIPTION OF EMBODIMENTS

In the following text, a detailed description of examples will be given with reference to the drawings. It should be understood that various modifications to the examples may be made. In particular, one or more elements of one example may be combined and used in other examples to form new examples.

Figure 1B:
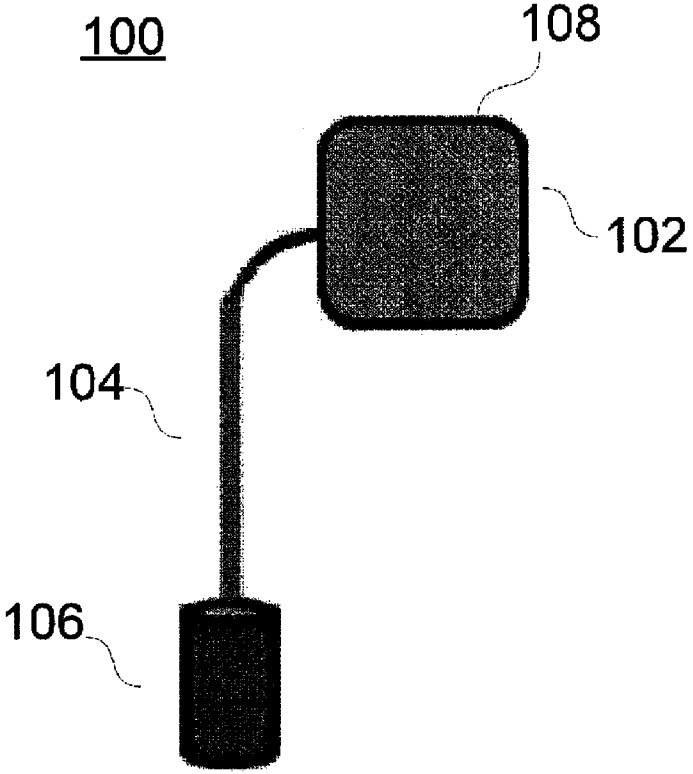
FIGS. 1A and 1B show an example of a tactile button device.
Figure 1A:
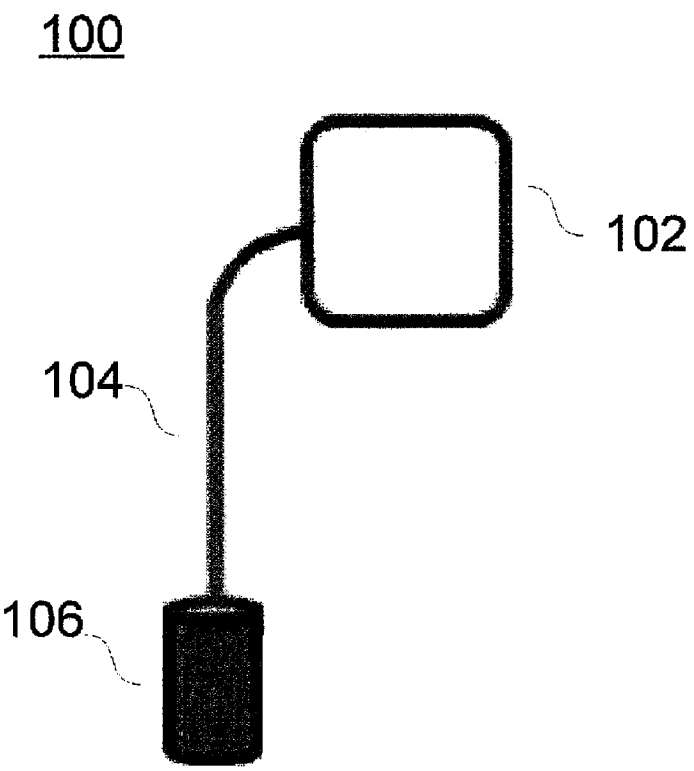

FIGS. 1A and 1B show an example of a tactile button device according to one embodiment. The tactile button device 100 shown in FIG. 1A may include a receptacle 102 connected to a connector 106 via a duct 104. It should be noted that, although FIG. 1A shows only one receptacle 102, the tactile button device may include more than one receptacle 102. Exemplarily, the receptacle 102 may be a small bag and the duct 104 may be a tube with one end in communication with the inside of the receptacle 102 and the other end leading into the connector 106. The connector 106 may connect the duct 104 and hence the receptacle 102 to a detection device 500 (described below with reference to FIGS. 5 and 6A-6D), a processing and communication assembly 866 (described below with reference to FIG. 4) and/or a material supply (not shown). In FIG. 1B the tactile button device 100 is shown in a configuration in which the receptacle 102 is filled with a material 108. The material 108 may be, for example, a fluid, such as a gas or a liquid, or a solid such as a granular material, which is a conglomeration of discrete solid particles (e.g. beads).

Exemplarily, the receptacle 102 may be adapted to be filled with the material 108 via the duct 104, wherein the material 108 from a material supply may enter the connector 106 and then be transported through the duct 104 and finally enter the receptacle 102. For example, the receptacle 102 may be composed of a deformable, resilient medium that allows the receptacle 102 to be inflated by the material 108. In another example, the receptacle 102 may be provided already in an inflated state, filled with the material 108. In other words, a material supply and a filling operation through the duct 104 may not be necessary.

When pressure is applied from the outside (e.g. by the finger of an operator) on the receptacle 102 filled with the material 108, the receptacle 102 may deform and the material 108 may be displaced from the receptacle and travel through the duct 104. When the material 108 reaches the connector 106, a detection device 500 connected to the connector 106 may detect the pressure that was applied on the material 108 in the receptacle 102 and then transmitted through the duct 104 and the connector 106 by means of displacement of the material 108 itself. In an example, the characteristics of the material 108 may include low compressibility (isothermal compressibility approximately $10^{-11}$ $Pa^{-1}<\beta<10^{-9}$ $Pa^{-1}$, for example $10^{-11}$ $Pa^{-1}<\beta<10^{-10}$ $Pa^{-1}$) and/or low viscosity (between approximately $10^{-5}$ Pa·s and $10^{-3}$ Pa·s) to ensure a reliable and prompt transmission of the applied pressure from the receptacle 102 to the connector 106. The compressibility is a measure of the relative volume change of the material 108 as a response to the pressure change. When the receptacle 102 is deformed because of the applied pressure, the volume available for the material 108 may be reduced. If the material 108 has a low compressibility, the volume of the material 108 is not substantially reduced by the applied pressure and therefore a fraction of the material 108 may be displaced out of the receptacle 102 and into the communicating duct 104. The viscosity is a measure of the resistance of the material 108 to gradual deformation as a response to the pressure change. In other words, the viscosity indicates the rate of change of the displacement of the material 108. In an example, the material 108 may have low viscosity and move rapidly through the duct 104 into the connector 106.

The material 108 may be, in general, a fluid-like material, in the sense that it deforms continually and flows under the applied pressure. In other words, when subjected to pressure, the material 108 does not undergo a rigid displacement as a whole. A rigid displacement may be, at a first approximation, characterized in that the relative distance between pairs of points of a material remains substantially unaltered during the displacement. In e.g. a Bowden cable a mechanical force is transmitted by a rigid displacement of an inner cable relative to a hollow outer cable. A Bowden cable requires a generally stiff structure and is subject to wear because of the friction. Conversely, the particles constituting a fluid-like material (e.g. the molecules of a fluid or the discrete particles of a granular material) are not rigidly bound together, hence the displacement takes place in the form of a flow. A fluid-like material may be suitable for transmitting pressure in flexible, light structures and does not present wear problems. The material 108 may be, exemplarily, distilled water or an ensemble of glass beads. These materials have also a lower cost with respect to the e.g. steel normally used for a Bowden cable.

The material 108 may, in one example, be freely provided in the receptacle 102 and the displacement of the material 108 may be caused by a direct effect of the pressure applied to the receptacle 102. In other words, the walls of the receptacle 102 alone may define the volume and shape of the fluid-like material 108, such that the deformation of the receptacle 102 in response to the pressure directly affects the volume available for the material 108. In another example, an intermediary agent may be interposed between the material 108 and the receptacle 102 and the displacement of the material 108 may be caused by an indirect effect of the pressure applied to the receptacle 102. Exemplarily, a sponge may at least partly fill the receptacle 102 and the material 108 (e.g. distilled water) may soak the sponge. When pressure is applied on the receptacle 102, the sponge may be compressed so that the material 108 previously contained in the sponge is at least partly squeezed out and, due to an insufficient volume of the free space in the receptacle 102, is subsequently displaced e.g. into the duct 104.

Exemplarily, the tactile button device 100 may trigger a controlling action by transmitting the pressure with the displacement of the material 108 to a processing and communicating assembly 866 connected to the connector 106, as explained below with reference to FIGS. 4A to 4C. The tactile button device 100 may be detached from sensitive electronic components and hence suitable to be sterilized. When the tactile button device 100 is attached to a consumable component such as a single-use bag, an operator may utilize the consumable component itself as a control panel, and the tactile button device may undergo sterilization (such as gamma irradiation or autoclaving) along with the consumable component. Alternatively, the tactile button device 100 may serve as a sterilizable and/or disposable control panel to activate a process-related function in a process device when e.g. the operator is wearing gloves that are soiled from working in a production facility.

Figure 2:
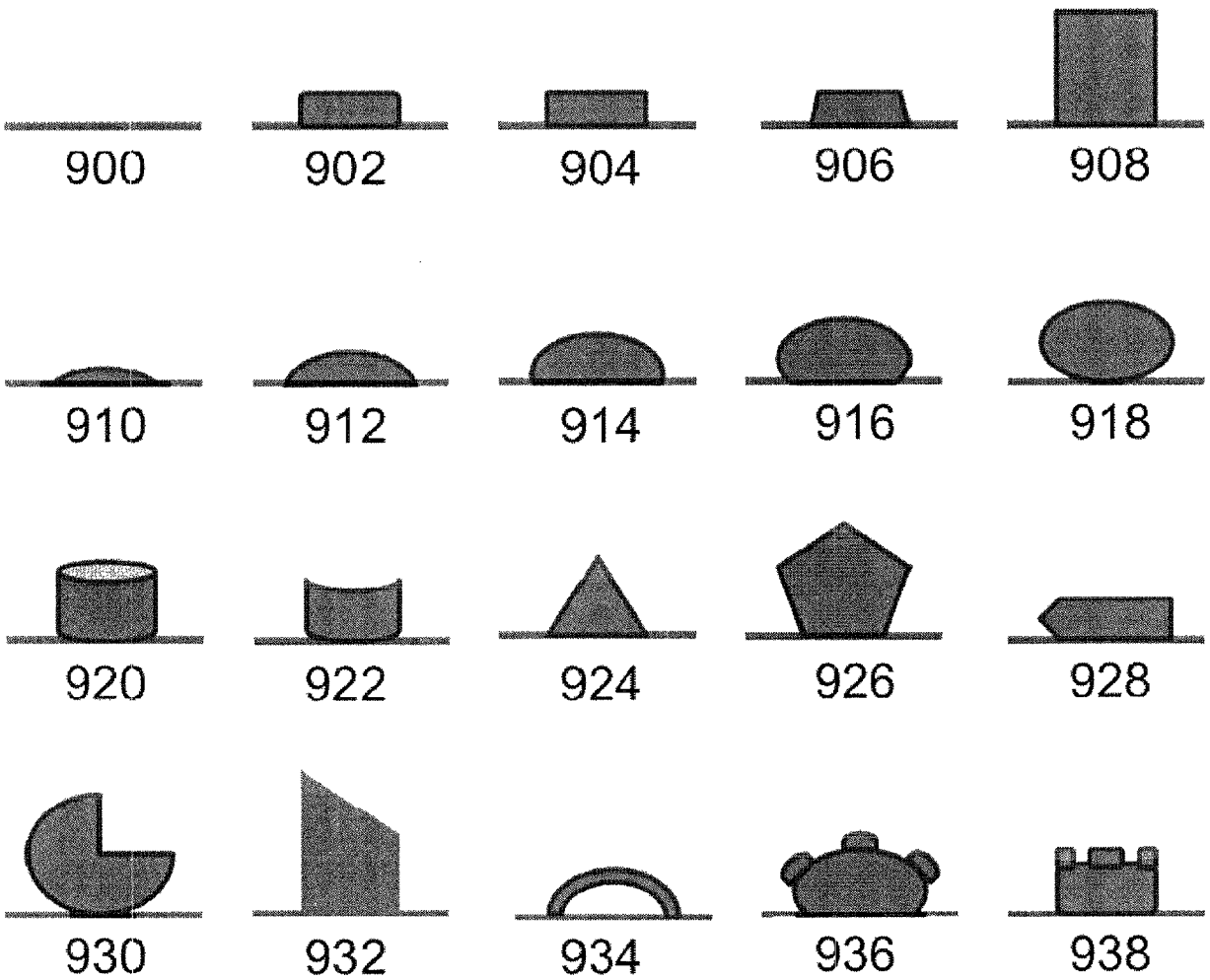
FIG. 2 shows examples of receptacles formed as buttons with different shapes.

Exemplarily, the receptacle 102 may be configured as a button with different shapes. FIG. 2 shows examples of receptacles formed as buttons with different shapes. The shapes shown in FIG. 2 represent some, but by no means all, iterations of the possible shapes that can be constructed in a plurality of sizes and/or constructions. In a side profile, the button may be in a noninflated state 900, a rounded rectangle button 902, an angular rectangle button 904, a trapezoidal button 906, a tall rectangular button 908, a spherical or elliptical button with varying degrees of presentation 910, 912, 914, 916, 918, a cylindrical button 920, a cylindrical button with a depressed tip 922, a triangular button 924, a pentagonal button 926, a multi-angular button 928, a spherical button with a depression 930 to form a region for a finger, a tall button with an angle 932 so that it may be pushed like a lever, a looped button 934, a multi-shaped button that contains features on top of the button 936, and an alternate multi-shaped button 938 that forms a region for the finger to depress. The button shapes may also comprise one or more protective structures at least partly surrounding the button shapes to prevent an accidental push or that the pressing of one button be registered as the pressing of a different, adjacent button. The protective structures may be in the form of barriers raised between adjacent buttons or pockets constructed around each button shape.

Figure 3:
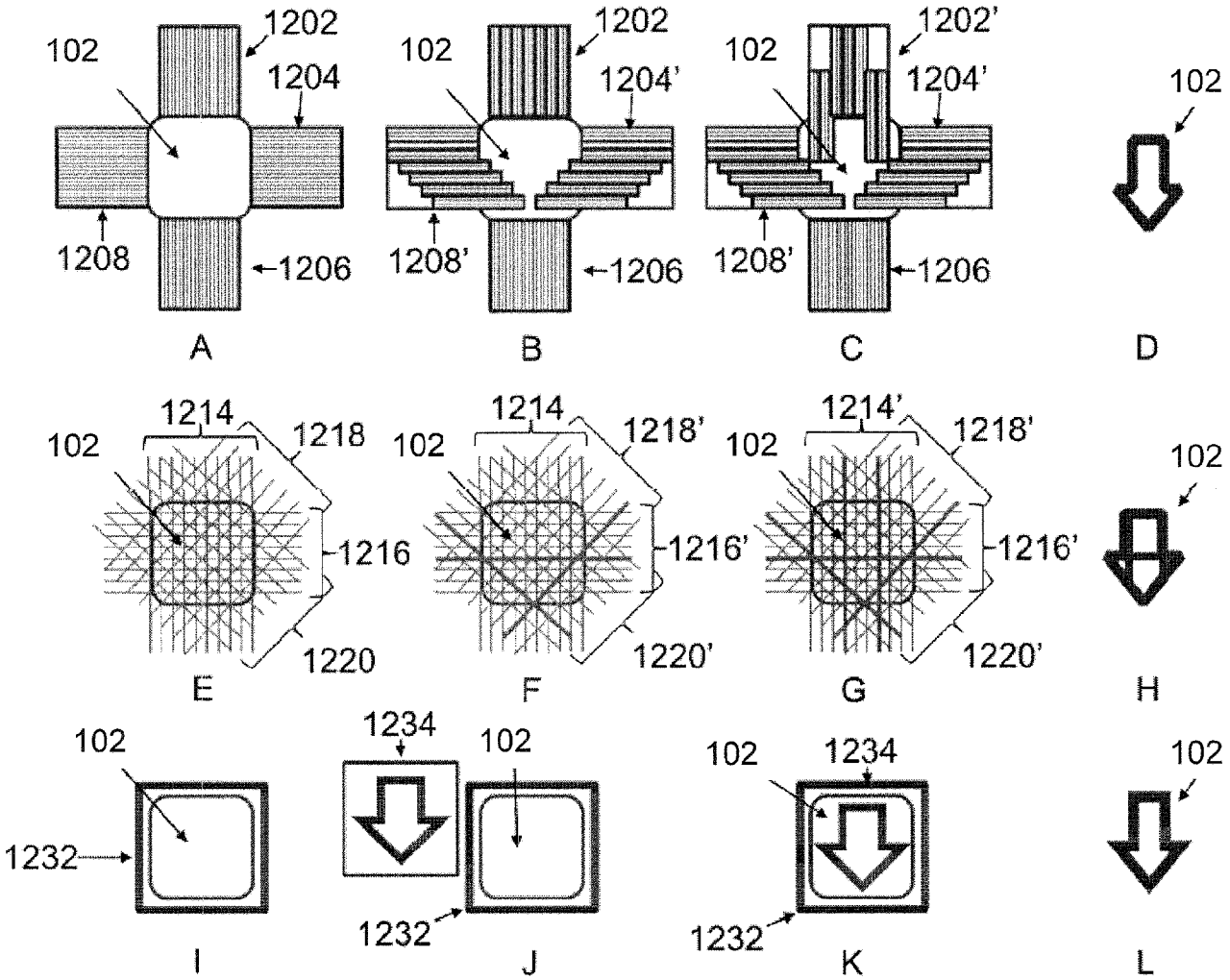
FIG. 3 shows examples of means to modify the configuration of a receptacle.

The appearance of the receptacle 102 may vary not only in its cross-section, as shown in FIG. 2, but also when observed from above. Exemplarily, modification members may be provided to enable an operator to change the aspect of the receptacle 102 e.g. so that a top view may represent a universally-known symbol such as an arrow. The modification members may not cover or only partially cover the receptacle 102 in a first arrangement. In a second, subsequent arrangement the modification members may be moved and/or altered to define the desired configuration on the top surface of the receptacle 102. FIG. 3 shows examples of means to modify the configuration of a receptacle.

View 'A' is a top view of a receptacle 102 with movable block frames 1202, 1204, 1206, 1208 on four sides of the receptacle 102. View 'B' is a top view of the receptacle 102 where the left movable block frames 1208' and the right movable block frames 1204' are moved into a position conducive to the desired configuration. View 'C' is a top view of the receptacle 102 where the top movable block frames 1202' are moved into position. View D' is a top view of the inflated receptacle 102 as observed by e.g. an operator. The configuration of the receptacle 102 has been shaped by the movable block frames 1202, 1204, 1206, 1208 in that block frames 1202, 1204 and 1208 have been moved from a position external to the outer perimeter of the top surface of the receptacle 102 to a position in which block frames 1202', 1204' and 1208' partially cover the top surface of the receptacle 102, forming the contours of the desired configuration. The movable block frames 1202, 1204, 1206, 1208 may be moved into position manually, e.g. by the fingers of the operator, or by an automated system with e.g. robotic arms. The movable block frames 1202, 1204, 1206, 1208 may be colored and opaque, completely concealing the surface, or transparent to the operator, for example providing contours by means of depth and/or shading effects.

View 'E' is a top view of a receptacle 102 with a series of cables 1214, 1216, 1218, 1220 stretching across four sides of the receptacle 102 within a frame. View 'F' is a top view of the receptacle 102 where specific cables 1216', 1218', 1220' are altered so as to become visually prominent, for example by bringing closer neighboring cables in order to increase the thickness and/or by tightening cables to make them conspicuous in relation to relatively looser cables. View 'G' is a top view of the receptacle 102 where additional specific cables 1214' are tightened to contribute further to the shaping of the configuration. View 'H' is a top view of the inflated receptacle 102 as observed by e.g. an operator. The configuration of the receptacle 102 has been shaped by the series of cables 1214, 1216, 1218, 1220 in that specific cables 1214', 1216', 1218', 1220' have been altered to be noticeable and used as line contours to create a desired configuration. The specific cables 1214', 1216', 1218', 1220' in the series of cables 1214, 1216, 1218, 1220 may be manually altered by the operator or by an automated system with e.g. pulleys. In place of cables, strings, wires, cords or other thread-like members may be used.

View 'I' is a top view of a receptacle 102 with a locking frame 1232 around the receptacle 102. View 'J' is a top view of the receptacle 102 where a mask 1234 containing a specific shape is brought in. View 'K' is a top view of the receptacle 102 with the mask 1234' containing the specific shape being locked into the locking frame 1232. View 'L' is a top view of the inflated receptacle 102 as observed by e.g. an operator. The configuration of the receptacle 102 has been modified by the mask 1234 containing the specific shape. Different masks may be manually added to provide different observable configurations of the receptacle 102. For example, a mask may present a different shape, a different texture and/or a different size. The mask 1234 containing the specific shape may be colored and opaque, completely concealing the surface of the receptacle 102, or with a transparent background that shows only the specific shape on top of the surface of the receptacle 102.

Further to the at least one receptacle 102, the tactile button device 100 of FIGS. 1A and 1B may comprise, as explained above, a duct 104 and a connector 106. The connector 106 is the component of the tactile button device 100 that enables the receptacle 102 and the duct 104 to be detachably connected to external devices. In an example, the tactile button device 100 may be sterilized when the tactile button device 100 is detached from sensitive components not suitable to be sterilized.

The external devices may include, but are not limited to, a detection device 500, a material supply and/or a processing and communicating assembly 866. The detection device 500 will be discussed below with reference to FIG. 5.

A material supply may be the source providing the material that is introduced into the receptacle 102 via the duct 104. The material supply may be e.g. a fluid reservoir attached to a pump. Exemplarily, the material supply may be connected to the tactile button device 100 before sterilization, and the tactile button device 100 may then be sterilized when the receptacle 102 is already filled with the material 108.

A processing and communicating assembly 866 may include components configured to process the detection of pressure applied to the receptacle 102 and communicate a corresponding signal to a controlling device responsible for controlling an external item to which the tactile button device 100 may be attached. In an example, the processing and communication assembly 866 may be in communication (e.g. by means of an electrical and/or mechanical connection) with the detection device 500 that detects the pressure applied to one or more receptacles 102. In a further example, the processing and communicating assembly 866 may be connected to the tactile button device 100 after sterilization.

The connector 106 may comprise a fastening section to facilitate attaching with external devices. In an example, each external device may be connected individually and separately to the connector 106 by means of a mating connector 860 removably attachable to the connector 106 to form a connector assembly 862. In another example, one or more of the external devices may be contained in the mating connector 860. FIGS. 4A-4C show an example of a connector assembly 862. The connector assembly 862 may comprise a connector 106 and a mating connector 860 removably attachable to each other.

Figure 4C:
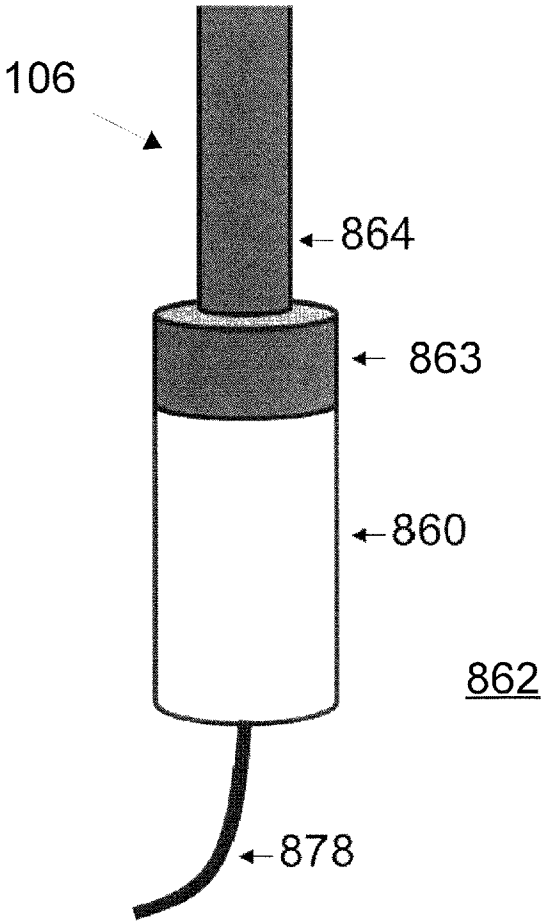
FIGS. 4A to 4C show an example of a connector assembly.
Figure 4B:
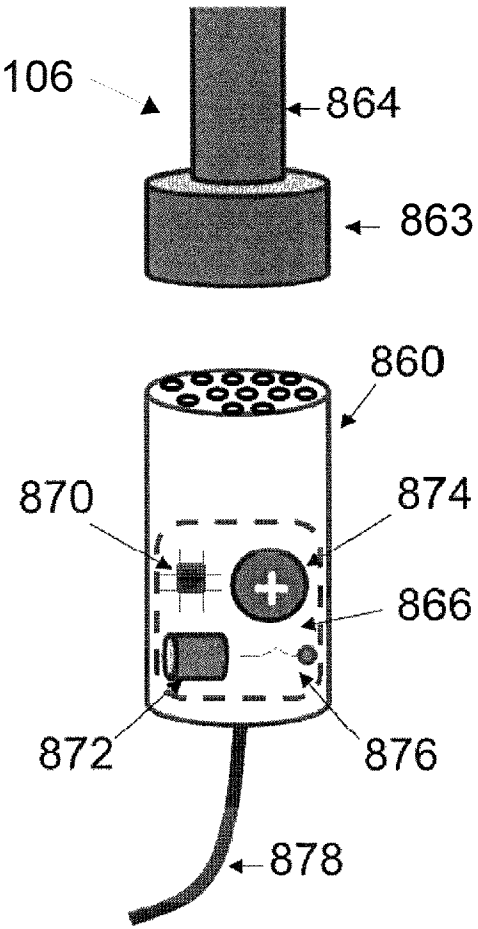
Figure 4A:
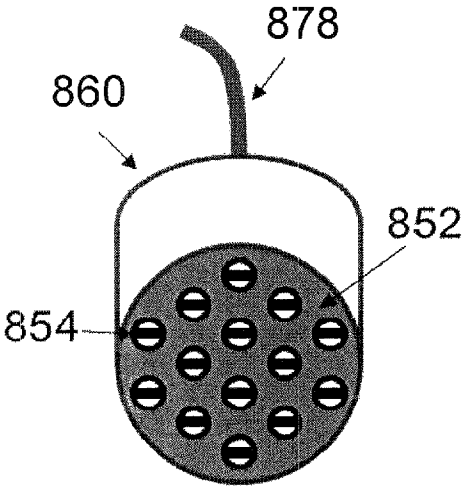

FIG. 4A is a top view of the mating connector 860 of the connector assembly 862 that may contain a rigid housing 852 with a plurality of holes 854 into which one or more ducts 104 (not shown) may connect. Exemplarily, each of the plurality of holes 854 may be a switch capable of opening/closing an electrical circuit and serve as a detection device (as explained in further detail below with reference to FIG. 6A). Hence, if a plurality of receptacles 102 are connected to the mating connector 860, an individual detection device for each receptacle 102 and each duct 104 may be provided. In another example, the detection device 500 may be external to the mating connector 860. In an example, the mating connector 860 may utilize a common material line 878 connected to a material supply to fill one or more of the receptacles 102 with a specified amount of material 108. In other examples, this material 108 may be self-contained within the mating connector 860 or different material lines may be dedicated to different receptacles 102.

FIG. 4B is a front view of the connector assembly 862 with the mating connector 860 detached from the connector 106 and FIG. 4C is a front view of the connector 106 connected to the mating connector 860 to form the connector assembly 862.

In an example, the connector 106 may comprise a fastening section 863 configured be fastened to the upper part of the mating connector 860 and a tubular section 864 that may aid in channeling one or more individual ducts 104 into the connector assembly 862. The tubular section 864 and the fastening section 863 of the connector 106 may spread out the ducts 104 so that they may be connected to the individual detection devices 854 of the mating connector 860. Exemplarily, the separation of the two components 860 and 106 may enable the connector 106 of the tactile button device 100 to be sterilized with a consumable component such as a single-use bag, while the mating connector 860, containing the sensitive electronics, may be connected to the connector 106 after sterilization, avoiding the required shielding of the electronic components to resist sterilization procedures.

In an example, the mating connector 860 of the connector assembly 862 may contain a processing and communication assembly 866 including a processing device 870, a storage device 872 (e.g. a flash memory), a communication device 876 (e.g. a wireless communication device such as WiFi or Bluetooth® communication), and/or a power device 874 such as a battery. In another example, the mating connector 860 may comprise a wired or wireless power source (including e.g. inductive charging or solar cells). In a further example, the processing and communication assembly 866 may be externally connected to the mating connector 860 and not integrated into it. Exemplarily, the processing and communication assembly 866 may be electrically connected to the plurality of holes 854 functioning as switches. Once a pressure has been detected by at least one of the plurality of holes 854 connected via a duct 104 to a receptacle 102, the processing device 870 may retrieve the corresponding action associated with that particular receptacle 102 and let the communication device 876 produce a signal to an external controlling device that is configured to carry out the specific (predetermined or predeterminable) action, which may be, but is not limited to, displaying information and/or activating a process related function.

Figure 5:
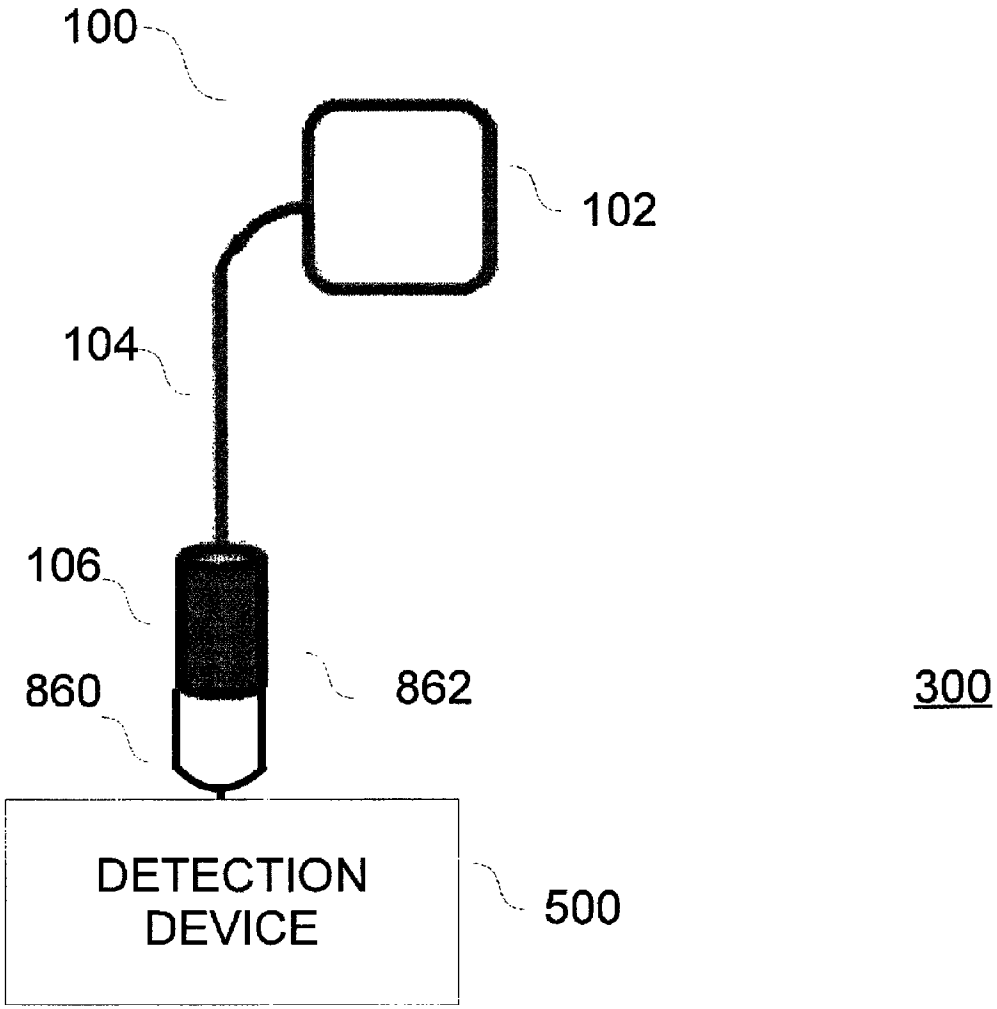
FIG. 5 shows an example of a tactile button assembly comprising a tactile button device and a detection device.

FIG. 5 shows an example of a tactile button assembly 300 comprising a tactile button device 100 and a detection device 500. The tactile button device 100 is connected via the connector 106 and the mating connector 860 to the detection device 500. As illustrated above, in an example, the detection device 500 may be an external device connected to the mating connector 860 by means of e.g. wiring. In another example, the detection device 500 may be integrated into the mating connector 860 (e.g. in the form of a plurality of holes 854). The detection device 500 may detect a pressure exerted on the receptacle 102 when the receptacle 102 is filled. As explained with reference to FIGS. 1A and 1B, a pressure applied to the filled receptacle 102 may cause a displacement of the material 108 contained in the receptacle 102. Once the displaced material 108 has passed through the duct 104, the material 108 is guided by the connector 106 into the mating connector 860. From the connector assembly 862, the material 108 may interact with the detection device 500 and activate detection means provided in the detection device 500. Exemplarily, the pressure of the material 108 may affect an initial, static configuration of the detection means and bring the detection means into a second configuration, different from the first configuration. The occurrence of the second configuration may indicate that a pressure has been detected by the detecting means in the detection device 500. The receptacle 102 may be pressed in a pressing pattern such as a single press, a double-press, a long press, and/or a series of presses. Each pressing pattern according to which the receptacle 102 is pressed by an operator may correspond to a different (predetermined or predeterminable) action associated with the receptacle 102.

Figures 6A, 6B, 6C, 6D:
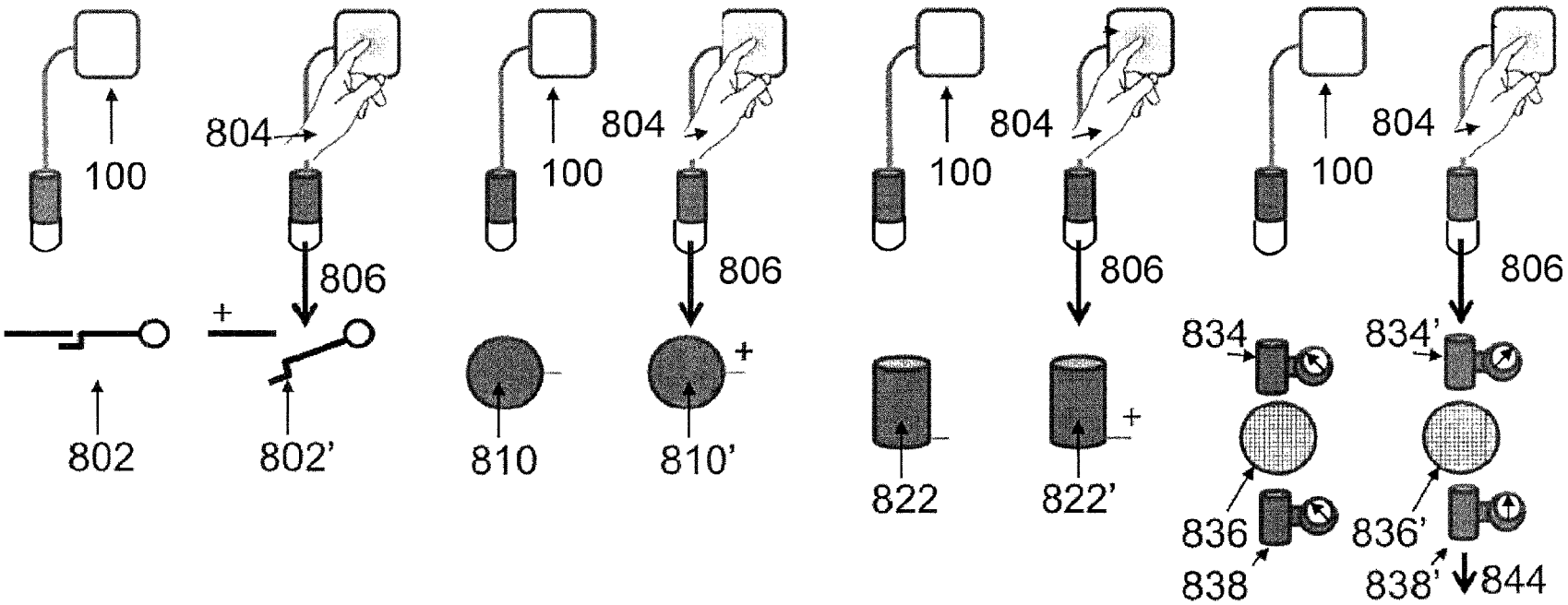
FIGS. 6A to 6D show examples of the detection means employed by a detection device.

FIGS. 6A to 6D show examples of the detection means employed by the detection device 500. FIG. 6A is a front view of a gate mechanism (electric, mechanical, or electromechanical) for the detection of the pressed receptacle 102. The tactile button assembly 300 comprises a tactile button device 100 and a detection device 500 that, in an example, may include an electric switch with a hinge 802, shown in a static state with a small electric current running through, thereby completing a circuit. When an operator 804 presses the receptacle 102, the pressure of the material 108 coming through the duct 104 and the connector assembly 862 into the detection device 500 may push in an outward direction 806 and open the electric switch 802' disconnecting the electric circuit. Exemplarily, a processing device 870 as described with reference to FIG. 4B (not shown) and connected to the detection device 500 may record that this particular receptacle 102 was pressed. If the tactile button device 100 comprises a plurality of receptacles 102, dedicated, individual electric switches may be utilized for each receptacle 102 and corresponding duct 104.

FIG. 6B is a front view of a pressure sensor that may be, but is not limited to, one of a diaphragm, capacitive, electromagnetic, piezoelectric, piezoresistive strain gauge, potentiometric, membrane, and/or optical sensor for the detection of the pressed receptacles 102. In an example, the detection device 500 may comprise a pressure sensor 810, shown in a static state. When an operator 804 presses the receptacle 102, the pressure of the material 108 coming through the duct 104 and the connector assembly 862 into the detection device 500 pushes in an outward direction 806 and may be detected by the pressure sensor 810'. Exemplarily, a processing device 870 as described with reference to FIG. 4B (not shown) and connected to the detection device 500 may record that this particular receptacle 102 was pressed. If the tactile button device 100 comprises a plurality of receptacles 102, a dedicated pressure sensor 810 may be utilized for each receptacle 102 and corresponding duct 104. In another example, a general pressure sensor 810 with the resolution to determine the location of the pressure on the pressure sensor 810 may be utilized for all or for blocks of receptacles 102.

FIG. 6C is a front view of a pressure transducer for the detection of the pressed receptacle 102. In an example, the detection device 500 may comprise a pressure transducer 822, which has higher sensitivity than the pressure sensor 810 shown in FIG. 6B, and is shown in a static state. When an operator 804 presses the receptacle 102, the pressure of the material 108 coming through the duct 104 and the connector assembly 862 into the detection device 500 pushes in an outward direction 806 and may be detected by the pressure transducer 822'. Exemplarily, a processing device 870 as described with reference to FIG. 4B (not shown) and connected to the detection device 500 may record that this particular receptacle 102 was pressed. If the tactile button device 100 comprises a plurality of receptacles 102, a dedicated pressure transducer 822 may be utilized for each receptacle 102 and corresponding duct 104. In another example, the pressure transducer 822 may be utilized in conjunction with a switch mechanism to determine the location of the pressure for all or blocks of receptacles 102. The higher resolution of the pressure transducer 822 may allow for more information on how hard the receptacle 102 was pressed for finer control.

FIG. 6D is a front view of a differential pressure sensor for the detection of the pressed receptacle 102. In an example, the detection device 500 may comprise a differential pressure sensor with an upstream pressure sensor 834, a membrane or diaphragm 836, and a downstream pressure sensor 838, shown in a static state. When an operator 804 presses the receptacle 102, the pressure of the material 108 coming through the duct 104 and the connector assembly 862 into the detection device 500 pushes in an outward direction 806 and may be detected by the differential pressure sensor 834, 836, 838 where the upstream pressure is different from the downstream pressure as the fluid passes through the membrane 836. Exemplarily, a processing device 870 as described with reference to FIG. 4B (not shown) and connected to the detection device 500 may record that this particular receptacle 102 was pressed. If the tactile button device 100 comprises a plurality of receptacles 102, a dedicated differential pressure sensor 834, 836, 838 may be utilized for each receptacle 102 and corresponding duct 104. In another example, the differential pressure sensor 834, 836, 838 may be utilized in conjunction with a switch mechanism to determine the location of the pressure for all or blocks of receptacles 102.

The pressure applied to the receptacle 102 and transmitted to the detection device 500 by means of displacement of the material 108 contained in the receptacle 102 has the function of triggering an action (associated with the receptacle 102) regarding an external item. As explained above, an external item may be, for example, a consumable component. In an example, the tactile button device 100 may be manufactured together with the consumable component, as an integral element of the consumable component. In another example, the tactile button device 100 may be manufactured separately and attached to the consumable component at a later stage. The combination of the tactile button device 100 and the consumable component may constitute a single-use product, i.e. a product that may be discarded after a single use, due to the low cost of production for a tactile button device. Since the tactile button device 100 is suitable to be sterilized, the single-use product may be sterilized as a whole before use. FIGS. 7A-7D show an example of a tactile button device 100 on a consumable component.

FIG. 7A shows a front view of a single-use product comprising the tactile button device 100 on a single-use bag 200. The receptacle 102 may be integrated into the film layers of the single-use bag 200 or be attached to the single-use bag 200 by means of an attachment mechanism, for example by heat welding, as further explained below with reference to FIGS. 9 and 10. FIG. 7B shows a front view of the single-use product where the receptacle 102 has been filled with a material 108 that entered through the connector 106 in the direction shown by the direction arrow 109, and subsequently traveled through the duct 104 to arrive into the receptacle 102. FIG. 7C shows a front view of the single-use product where an operator's finger 112 may push on the receptacle 102 causing the material, subjected to the pressure, to travel through the duct 104 into the connector 106 in the direction shown by the direction arrow 110. FIG. 7D is a side view of the single-use product, showing a side profile of the single-use bag 200, the receptacle 102 and the duct 104 extending from the receptacle 102 into the connector 106.

Returning to FIGS. 1A and 1B, the tactile button device 100 may comprise at least one receptacle 102 shaped and configured according to the exemplary embodiments of FIGS. 2 and 3. In an example, the button assembly device 100 may comprise a plurality of receptacles 152. Each receptacle 102 of the plurality of receptacles 152 may be provided with its individual duct 104 and the individual ducts 104 may be connected and converge together into the tubing section 864 of the connector 106 (as shown in FIGS. 4B and 4C). As previously explained, when the tactile button device 100 comprises a plurality of receptacles 152, the detection device 500 may be capable of discerning the pressure applied on each receptacle 102 e.g. by means of dedicated detecting means.

Exemplarily, each receptacle 102 may serve a different function when pressed, wherein the function may be predetermined or predeterminable, e.g. may be set by an operator. The different functions of the plurality of receptacles 152 may be indicated by a different appearance of the plurality of receptacles 152. In other words, a visual indication of the effect produced when the material 108 in the receptacle 102 is subjected to pressure and the pressure is subsequently transmitted to a detection device 500 may be provided. In an example, at least some of the plurality of receptacles 152 may exhibit different colors, wherein the color may vary for each receptacle 102 or for groups of receptacles 102. The color of a receptacle 102 may be modified e.g. by changing the color of the filling material 108, if the receptacle medium is transparent or translucent. In another example, the plurality of receptacles 152 may be visually differentiated by means of labels applied to the receptacles 152. A label may be a static label showing information, e.g. an adhesive label with a writing or sign thereon. In a different example, a label may be a display means capable of dynamically changing its appearance, including e.g. color, texture and/or the information displayed thereon.

Figures 8A, 8B, 8C, 8D:
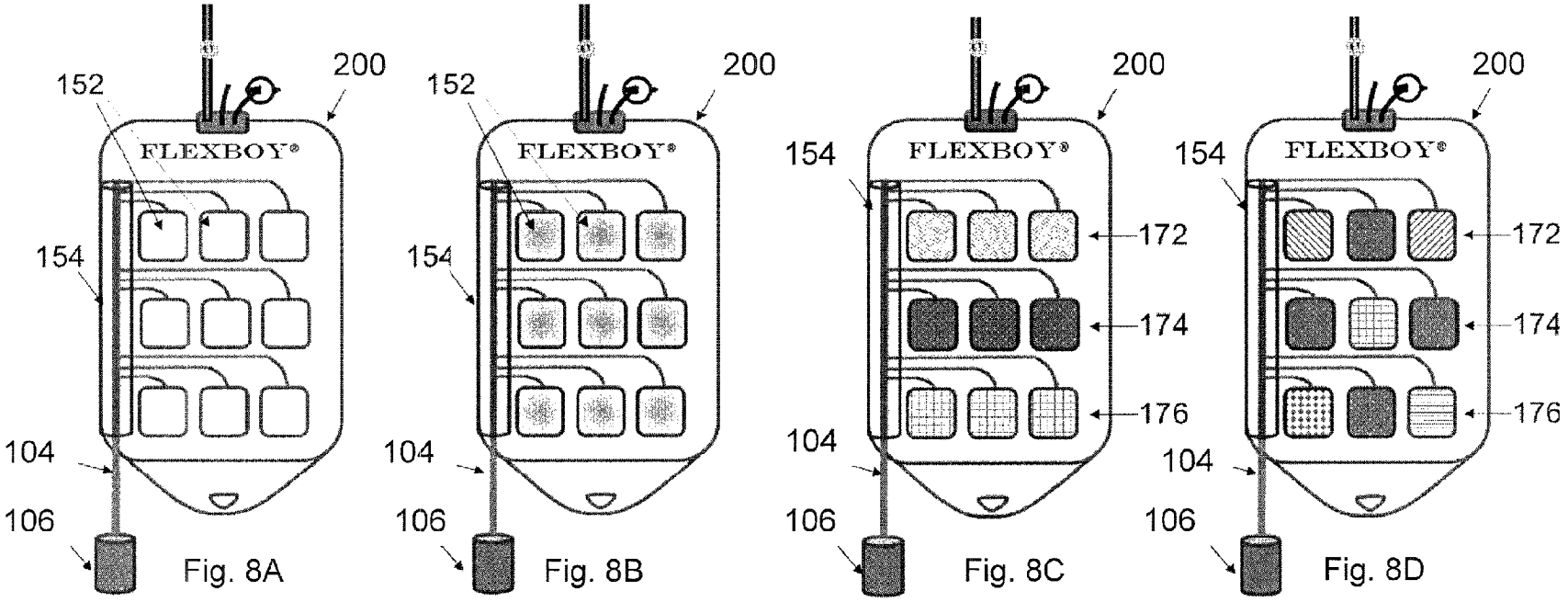
FIGS. 8A to 8D show examples of a tactile button device comprising a plurality of receptacles on a consumable component.

FIGS. 8A-8D show examples of a tactile button device 100 comprising a plurality of receptacles 152 on a consumable component 200. FIG. 8A shows a front view of a single-use product comprising a tactile button device 100 with a plurality of receptacles 152 on a single-use bag 200. The plurality of receptacles 152 may be connected via a network of ducts 104 from each of the receptacles and a common conduit assembly 154 may be utilized to bring together all of the ducts 104. The ducts 104 may be connected with the connector 106. FIG. 8B shows a front view of the single-use product where the plurality of receptacles 152 have been substantially filled with a material 108 that e.g. entered through the connector 106, the ducts 104 and the conduit assembly 154 into the plurality of receptacles 152. FIG. 8C shows a front view of the single-use product where each of the rows 172, 174,176 of receptacles 152 may be filled with a material 108 of a different color e.g. to differentiate the receptacles visually from one another. FIG. 8D shows another example in which the plurality of receptacles 152 are differentiated not by rows but by the individual receptacle.

Figures 9A, 9B, 9C, 9D:
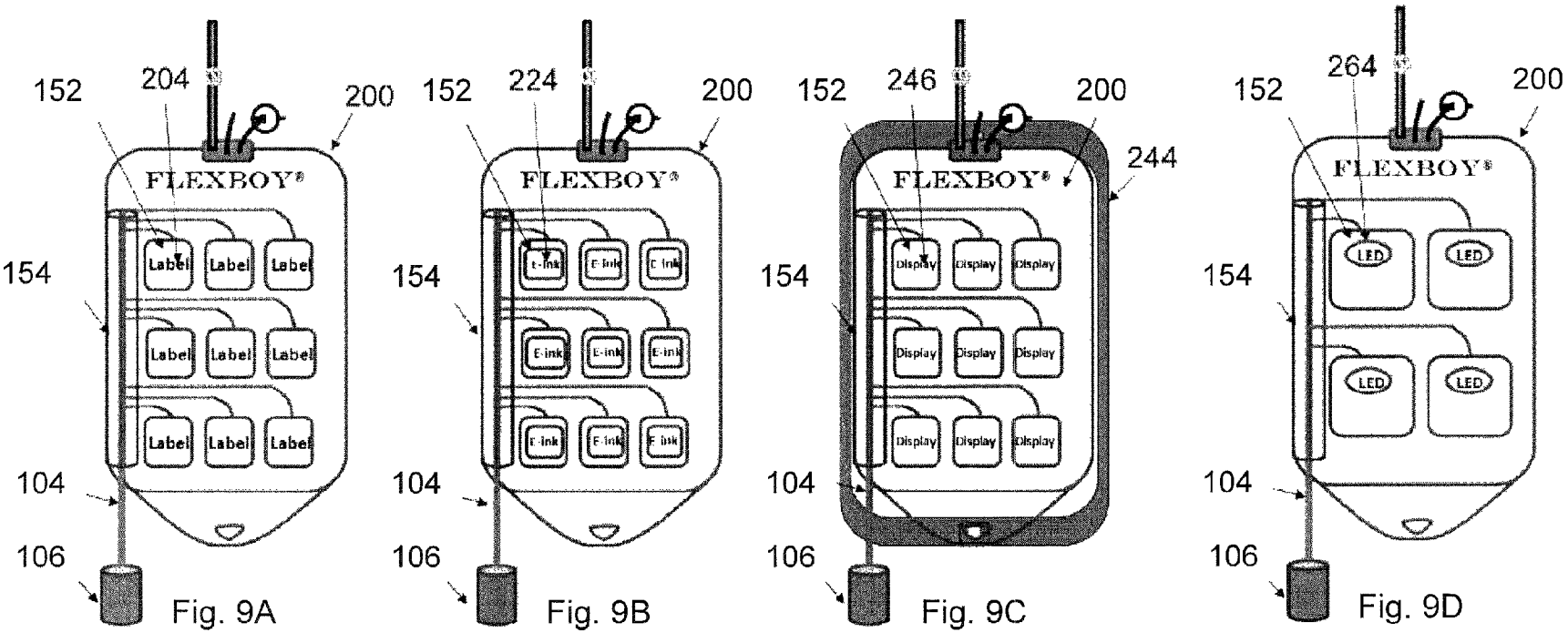

FIGS. 9A-9H show examples of a tactile button device 100 comprising a plurality of label-differentiated receptacles 152 on a consumable component 200. FIG. 9A shows a front view of a single-use product comprising a tactile button device 100 with a plurality of differentiated receptacles 152 on a single-use bag 200, wherein the plurality of receptacles 152 may contain a plurality of labels 204 to notify the operator the function of the receptacle if pressed. A label 204 may consist of a direct label on the surface of the receptacle 102. For example, printable ink may be used to print a label 204 directly on the surface, or a stamp impressed by means of ink, dyes, and/or coloring may be employed. In another example, labelling may occur from a change in the receptacle material, such as by means of laser excitation of an additive in the receptacle material, wherein the additive may change to a different color (e.g. a dark color), providing a readable label 204. In a further example, an adhesive label 204 may be utilized and affixed to the exterior and/or interior wall of the receptacle 102. The inks, dyes, adhesives and/or other labeling materials may need to prevent the migration of extractables and/or leachables into the single-use bag 200.

Extractables are chemical compounds that may be extracted from the labeling materials in the receptacle 102 and pass into the single-use bag 200 when in presence of a solvent (e.g. the filling material 108). Leachables are chemical compounds that may leach from the labeling materials in the receptacle 102 into the single-use bag 200 as a result of direct contact. Non-migrating materials may be utilized and/or a separating layer between the receptacle 102 and the single-use bag 200 may be utilized as a barrier against migration of any potential extractable/leachable materials. The suitability of a material for labeling may be determined experimentally under standard and worst-case conditions.

FIG. 9B shows a front view of a single-use product comprising a tactile button device 100 with a plurality of differentiated receptacles 152 on a single-use bag 200, wherein the plurality of receptacles 152 may contain a plurality of digital displays 224 to notify the operator the function of the receptacle if pressed. The digital displays 224 may be, for example, electronic ink displays due to the low power requirements, readability, and cost effectiveness but other digital displays such as OLED, LCD, LED, Plasma, and/or other displays may be utilized. The information provided by the digital displays may be, but is not limited to, an alert message, instructions about performing a task, or data about an operation (such as temperature, pH, time elapsed, etc.). The digital displays 224 may change the content presented to the operator according to different inputs, e.g. the pressing of the receptacle, the preferred language of the operator and/or the occurrence of a running operation. The digital displays 224 may change the presentation of information on the display. Exemplarily, the orientation of the labeling may be modified based on the orientation of the single-use bag 200 with respect to the operator, for example using an orientation sensor or accelerometer (not shown). The digital displays 224 may operate independently or in concert with other displays on the same item or on other external items or devices. The digital displays 224 may receive information from a stored local database, an external database, and/or a networked database. The digital displays 224 may constitute a single-use item and be discarded with the consumable component. In another example, the digital displays 224 may be attached and removed from the receptacles 152 of the single-use bag 200 using an attachment mechanism (e.g. removable adhesives) and hence may be multi-use. The digital displays 224 and associated electronics may be sterilization hardened according to the equipment they are utilized with (such as gamma hardened for gamma irradiation, thermally hardened for autoclaving/steam sterilization, or chemically hardened for vaporized hydrogen peroxide).

FIG. 9C shows a front view of a single-use product comprising a tactile button device 100 with a plurality of differentiated receptacles 152 on a single-use bag 200, wherein the plurality of receptacles 152 may utilize an external display device 244 that is positioned in alignment with the single-use bag 200. The external display device 244 may utilize the transparent nature of the single-use bag 200 to display labeling 246 for the receptacles 152 associated with the single-use bag 200. The external display device 244 may be, but is not limited to, a static display such as a label card affixed behind the single-use bag 200, a static digital display or a dynamic digital display from a tablet computer which may visually or electronically detect the positioning of the single-use bag 200 and automatically adjust the orientation of the labeling 246. In another example, the external display device 244 may be mounted above the single-use bag 200 and not behind it. In this case the receptacles 152 may utilize reflective and/or mirrored material to display the labeling 246 from the external display device 244. The external display device 244 may be a single-use item and discarded with the consumable component. In another example, given the external nature of the device, external display device 244 may be a multi-use device. The external display device 244 and the associated electronics may be sterilization hardened for the equipment it is utilized with. In another example, the external display device 244 may be attached to the item after the sterilization has been performed. In this case, it may be connected utilizing an attachment mechanism, such as adhesives, strings and/or interlocking members.

FIG. 9D shows a front view of a single-use product comprising a tactile button device 100 with a plurality of differentiated receptacles 152 on a single-use bag 200, wherein the plurality of receptacles 152 may contain a plurality of light emitting diode (LED) displays 264 to notify the operator the function of the receptacle if pressed. The LED displays 264 are simpler and cheaper than the digital display devices 246 of FIG. 6B. The LED displays 264 may show a color as an identifier to the operator. In another example, an LED array may be utilized for the display of numeric or alphanumeric characters. Infrared LED's may be utilized to provide information (such as encrypted coding or instructions) to an operator utilizing a device that can detect the signal from the infrared LEDs, exemplarily a heads-up display with an infrared camera. The LED displays 264 may operate independently or in concert with other displays on the same item or on other external items or devices. The LED displays 264 may receive information from a stored local database, an external database, and/or a networked database. The LED displays 264 may constitute a single-use item and be discarded with the disposable component. In another example, the LED displays 264 may be attached and removed from the receptacles 152 of the single-use bag 200 using an attachment mechanism (e.g. removable adhesive) and hence may be multi-use. The LED displays 264 and associated electronics may be sterilization hardened according to the equipment they are utilized with (such as gamma hardened for gamma irradiation, thermally hardened for autoclaving/steam sterilization, or chemically hardened for vaporized hydrogen peroxide).

FIG. 9E shows a front view of a single-use product comprising a tactile button device 100 with a plurality of differentiated receptacles on a single-use bag 200, wherein the plurality of receptacles may utilize a projection display device 284 which is positioned in proximity to the single-use bag 200 to project identifiable labels on the receptacles 152. For example, the projection display device 284 may provide real-time data, access to associated documentation, and/or instructions for assembly and operation of the single-use bag 200. The projection display device 284 may illuminate the single-use bag 200 from the top or side angle. In another example, the projection display device 284 may utilize the transparent nature of the single-use bag 200 by projecting the labeling and/or imaging through the single-use bag 200 from underneath. The projection display device 284 may produce a static projected display or a dynamic projected display that may visually or electronically detect the positioning of the single-use bag 200 and automatically adjust the orientation of the labeling. The receptacles 152 may utilize reflective and/or mirrored material to more prominently display the labeling from the projected display device 284. The projected display device 284 may be a single-use item (such as a pico-projector or an external LED light source) and discarded with the consumable component. In another example, given the external nature of the device, projected display device 284 may be a multi-use device. The projected display device 284 and the associated electronics may be sterilization hardened for the equipment it is utilized with. In another example, the projected display device 284 may be attached to the item after the sterilization has been performed. In this case, it may be connected utilizing an attachment mechanism, such as adhesives, strings and/or interlocking members.

FIG. 9F shows a front view of a single-use product comprising a tactile button device 100 with a plurality of differentiated receptacles 152 on a single-use bag 200, wherein the plurality of receptacles 152 may utilize a coded and/or augmented reality marker 306 recognized by an external augmented reality display device 308, 310 that may provide augmented reality labels 304. For example, labels 304 may provide information about the single-use bag 200. The augmented reality marker 306 may comprise optical markers, such as bar codes, color codes, pictograph, audio markers, the shape of items themselves, alphanumeric characters, and/or electromagnetic markers, such as transponders, radio frequency identification tags, near-field communication tags, metal stripes, and so on. In an example, the augmented reality marker 306 may be a simulated virtual marker that comprises a virtual geospatial location and shapes that are displayed on the display device 308, 310. The simulated virtual marker may be linked to a physical marker, object, and/or location and a physical occluder may be used to activate the simulated virtual marker. The augmented reality marker 306 may be a dynamic marker that changes configuration based on a connection, an input, and/or a preprogrammed interval. The augmented reality marker 306 may provide links to additional content and/or allow for relationship analysis with nearby and/or other connected parts. The augmented reality display device 308, 310 may be positioned facing the single-use bag 200 and moved based on the orientation and movement of the receptacles 152 on the single-use bag 200. The augmented reality display device 308, 310 may be, but is not limited to, a computer, a mobile device 308, for example a mobile phone or tablet computer, and/or a wearable device 310, e.g. augmented reality eyewear display (glasses, monocle, virtual reality display), a heads up display, a contact lens or other visual display device, a watch, or body worn haptic display or tracker, or other wearable device.

FIG. 9G shows a front view of a single-use product comprising a tactile button device 100 with a plurality of differentiated receptacles 152 on a single-use bag 200, wherein the plurality of receptacles 152 may utilize a plurality of chromic labels 334 that can modify their appearance based on an external stimulus. These chromic labels 334 may be for example thermochromatic, i.e. a color change may occur according to changes in temperature. The chromic labels 334 may be external to the single-use bag 200 or internal to the receptacles 152. In another example, the chromic labels 334 may be internal to film layers composing the single-use bag 200. In this case, chromic changes may be based on other factors such pH of the material, dissolved oxygen levels, protein concentration, and/or some other factor of the measured material. The chromic change may also be caused by a cascade of events in which an internal pH indicator emits heat that, in turn, activates an external chromic label.

FIG. 9H shows a front view of a single-use product comprising a tactile button device with a plurality of differentiated receptacles 152 on a single-use bag 200, wherein multiple label types are utilized on the same single-use bag 200. The plurality of receptacles 352, 356, 360, 364, 368 may utilize multiple label types that may include, but are not limited to, a standard label 354, a digital display label 358, a projection label 362, an LED label 366, and an augmented reality label 370. The labels may work independently, in concert with one another or in a network with other items or devices.

In another example, one or more receptacles 102 may be configured to provide information to an operator in that the receptacle 102 is shaped in order to serve as signage. In other words, the receptacle 102 may be manufactured in a specific, predetermined shape, for example by molding a single bag or by joining a series of small bags. The shape of the receptacle may be immediately recognized by an operator, thereby particularly providing a visual, language-independent indication about the state of the consumable component. FIGS. 10A-10D show examples of a tactile button device 100 with receptacles adapted for the display of information on a consumable component. FIG. 10A shows a front view of a single-use product comprising a tactile button device 100 in which the receptacle 556 is shaped to form an image or a symbol that may be associated with the state of the single-use bag 200. For example, the receptacle 556 may be in the shape of a biohazard sign indicating that the single-use bag 200 has been contaminated with a biohazardous organism and hence it informs the operator that the single-use bag 200 requires proper disposal. In another example, the receptacle 556 may be in the shape of a gamma sign indicating that the single-use bag 200 has been gamma irradiated and is sterile, e.g. ready for use. In another example yet, the receptacle 556 may be in the shape of a null sign indicating that the single-use bag 200 should not be used. Exemplarily, the receptacle 556 may be constructed as a singular or series of small bags which have been integrated into film layers composing the single-use bag 200 or attached to the single-use bag 200 using an attachment mechanism, for example by heat welding. The receptacle 556 may be filled with a colored fluid, exemplarily using a dye that does not migrate through the bag film layers. In another example, at least one additional barrier layer to prevent the migration of the dye may be at least partly provided between the receptacle 556 and the single-use bag 200. In a further example, the receptacle 556 may change color by a different method such as by means of a chromic pigment that changes color due to a change in temperature, pressure, light, electric current, pH, chemical reaction, and/or other chromism method, or by means of a pigment that becomes visible only when the receptacle inflates.

FIGS. 10B and 10C show a front view of a single-use product comprising a tactile button device 100 in which a plurality of receptacles 552, 554, 556 are shaped to form an image or a symbol that may be associated with the state of the single-use bag 200. In an example, a plurality of receptacles in the shape of a null sign 552, a gamma sign 554, and a biohazard sign 556 are provided on the same single-use bag 200. The plurality of signs may be provided on different areas of the single-use bag 200, as shown in FIG. 10B. In another example, the plurality of receptacles 552, 554, 556 may be located on top of one another so that only one sign can be viewed at a time on the single-use bag 200, as shown in FIG. 10C. Exemplarily, each of the plurality of receptacles 552, 554, 556 may be selectively filled with material 108 according to the state of the single-use bag 200 in order to determine the information provided to the operator. In other words, a receptacle 552, 554, 556 may be inflated only when the single-use bag 200 is in a corresponding state, i.e. the state symbolized by the sign into which the receptacle 552, 554, 556 is shaped. FIG. 10D is a side view of the single-use product shown in FIG. 10C, showing a side profile of the plurality of receptacles 552, 554, 556 stacked on top of one another.

Figure 11C:
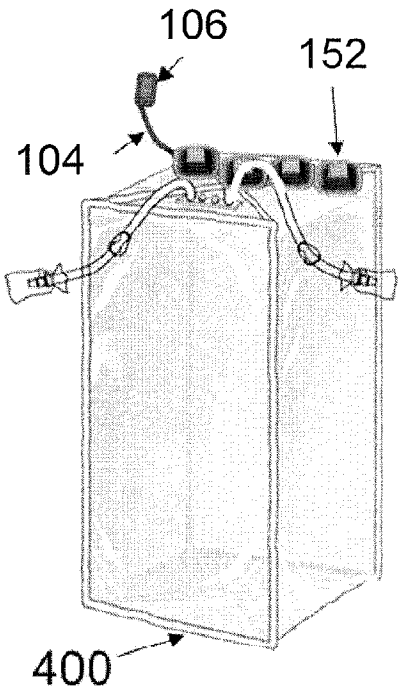
FIGS. 11A to 11C show examples of a tactile button device on a plurality of types of consumable component.
Figure 11B:
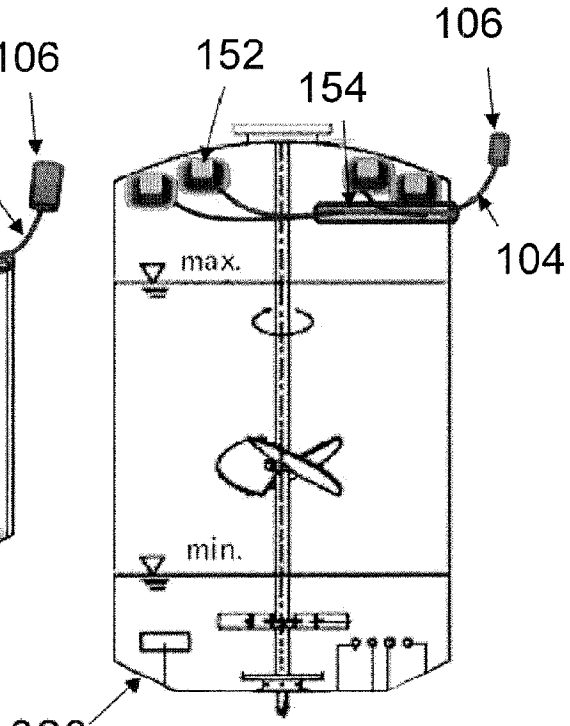
Figure 11A:
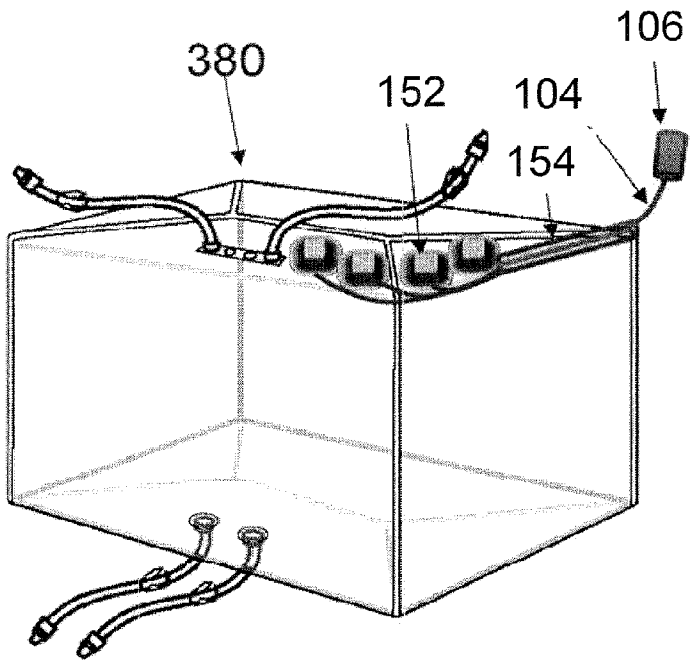

FIGS. 11A-11C show examples of a tactile button device 100 according to one of the examples illustrated above on a plurality of types of consumable components. A three-dimensional single-use bag 380 is shown in FIG. 11A. The tactile button device 100 may be, for example, situated on the top side of the three-dimensional single-use bag 380. A three-dimensional single-use mixing bag 390 containing a mixing device, for example an impeller, mixing blade, baffles, and/or other mixing device, is shown in FIG. 11B. The tactile button device 100 may be, for example, situated on the lateral side of the three-dimensional single-use mixing bag 390. A single-use drum bag 400 that may be an enclosed bag or a tank liner open at the top is shown in FIG. 11C. The tactile button device 100 may be, for example, situated on the top side of the single-use drum bag 400.

FIGS. 7 to 11 show different examples of single-use products comprising a tactile button device 100 and a consumable component such as a single-use bag 200. As mentioned above, in an example, the receptacle 102 of the tactile button device 100 may be manufactured separately and then attached to a consumable component by means of an attachment mechanism. Exemplarily, the consumable component may contain a thermoweldable layer onto which the receptacle 102 may be at least partly heat sealed. The receptacle 102 may be, for example, a small bag and its bottom surface may be at least partly attached to the top surface of the consumable component.

In another example, at least part of the tactile button device 100 may be defined by the consumable component. The receptacle 102 and the duct 104 may be, at least partly, integrally formed with the consumable component. A consumable component such as a single-use bag 200 may contain, for example, a series of film layers that may comprise, but are not limited to, at least one of a polyethylene, polyamide, ethyl vinyl alcohol (EVOH), polyethylene terephthalate (PET), ethylene vinyl acetate copolymer (EVAM) and linear low density polyethylene (LLDPE) layer. Exemplarily, the receptacle 102 and the duct 104 may be at least partly integrated into the film layers of the consumable component. The receptacle 102 may be formed as a pocket or a void chamber and the duct 104 may be, at least for a fraction of its length or extension, an internal tube or a narrow void chamber.

These two exemplary options of permanently providing a consumable component with a tactile button device are explained in further detail with reference to FIGS. 12A to 12D and FIGS. 13A to 13D.

Figure 12B:
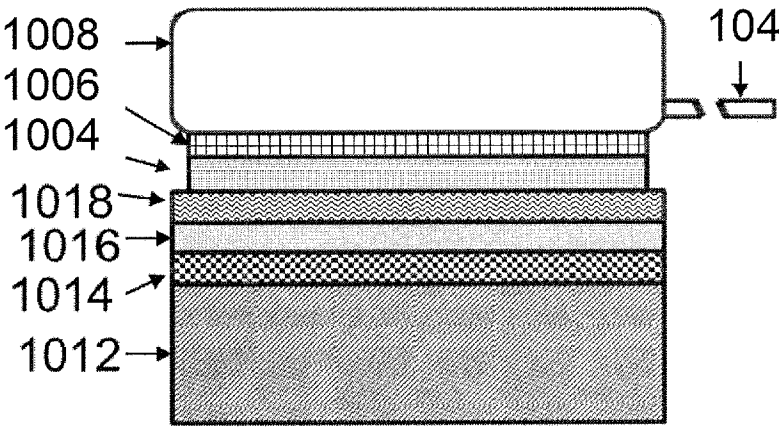
FIGS. 12A to 12D show examples of different single-use bag film layers thermowelded with an external receptacle of a tactile button device.
Figure 12D:
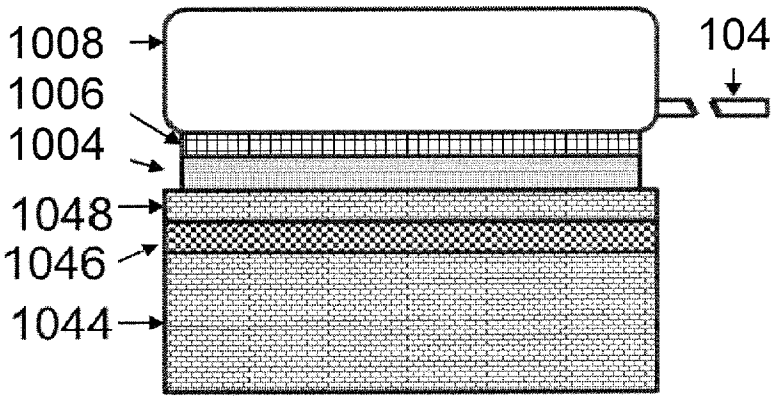
Figure 12A:
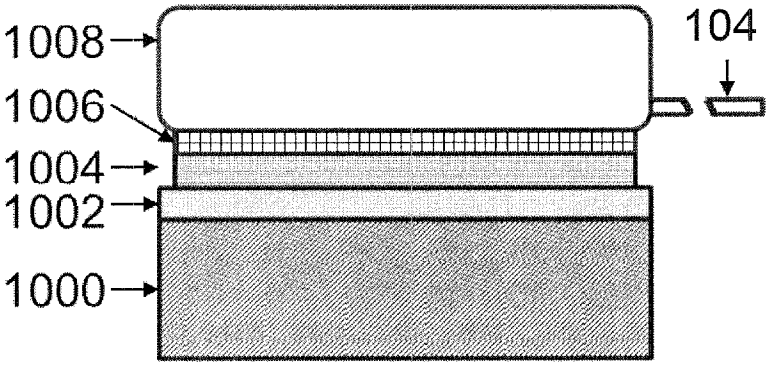
Figure 12C:
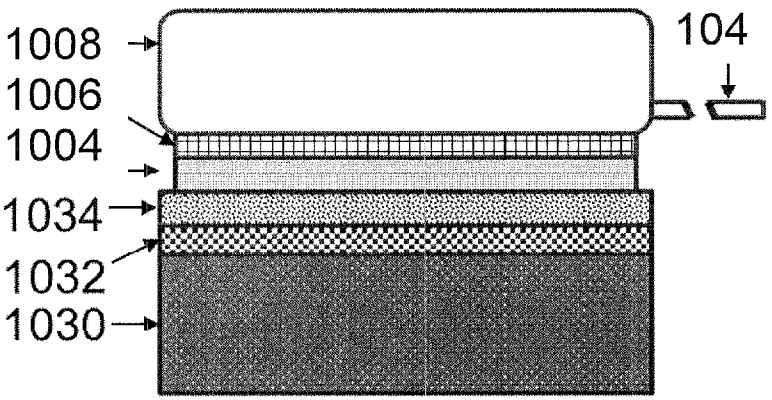

FIGS. 12A-12D show examples of different single-use bag film layers thermowelded with an external receptacle 102 of a tactile button device 100. FIG. 12A is a cross-section view of a single-use bag 200 that may contain polyethylene 1000 and polyamide 1002 film layers. Additionally the single-use bag may contain a thermoweldable layer 1004 onto which the external receptacle 102 is heat sealed. In an example, the receptacle 102 may include a barrier layer 1006 to prevent the material 108 used in the receptacle 102 from penetrating into the single-use bag film layers and an inflation layer 1008, which is the chamber that may be filled with the material 108 and may be pressed by an operator. The duct 104 may also be provided, e.g. in the form of a tube. FIG. 12B is a cross-section view of a single-use bag 200 that may contain polyethylene 1012, EVOH 1014, polyamide 1016, and PET 1018 film layers. Additionally the single-use bag 200 may contain a thermoweldable layer 1004 onto which the external receptacle 102 is heat sealed. The receptacle 102 and the duct 104 may exemplarily be configured as in FIG. 12A. FIG. 12C is a cross-section view of a single-use bag 200 that may contain first EVAM 1030, EVOH 1032, and second EVAM 1034 film layers. Additionally the single-use bag 200 may contain a thermoweldable layer 1004 onto which the external receptacle 102 is heat sealed. The receptacle 102 and the duct 104 may exemplarily be configured as in FIG. 12A. FIG. 12D is a cross-section view of a single-use bag that may contain first LLDPE 1044, EVOH 1046, and second LLDPE 1048 film layers. Additionally the single-use bag 200 may contain a thermoweldable layer 1004 onto which the external receptacle 102 is heat sealed. The receptacle 102 and the duct 104 may exemplarily be configured as in FIG. 12A.

Figure 13B:
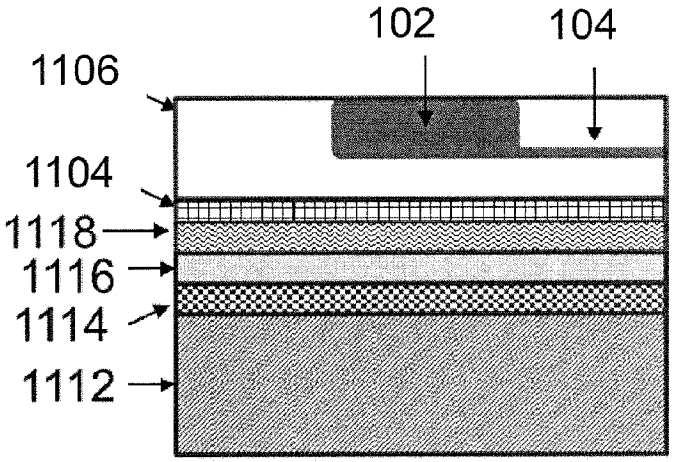
FIGS. 13A to 13D show examples of different single-use bag film layers with an internally-formed receptacle of a tactile button device.
Figure 13D:
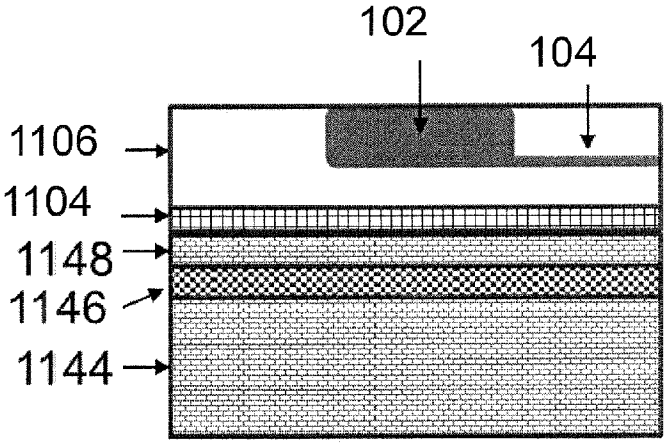
Figure 13A:
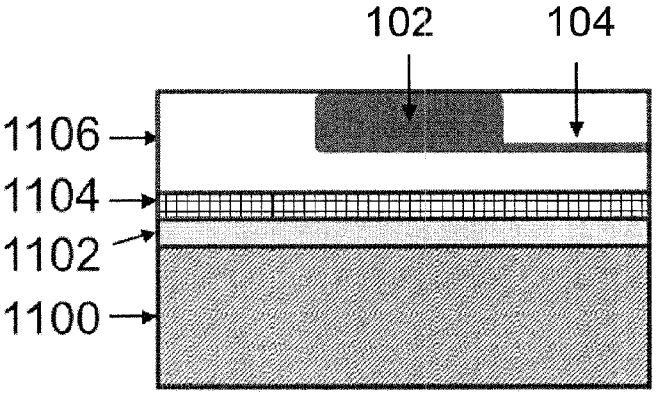
Figure 13C:
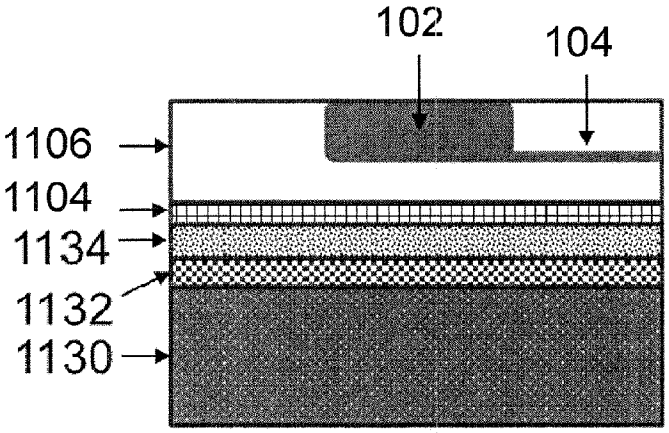

FIGS. 13A-13D show examples of different single-use bag film layers with an internally-formed receptacle 102 of a tactile button device 100. FIG. 13A is a cross-section view of a single-use bag 200 that may contain polyethylene 1100 and polyamide 1102 film layers. Additionally the single-use bag 200 may contain a barrier layer 1104 to prevent the material 108 used in the receptacle 102 from penetrating into the single-use bag film layers, an inflation layer 1106, which may comprise the receptacle 102 in the form of a pocket or void chamber that is filled with the material 108 and may be pressed by an operator, as well as the duct 104 in the form of an internal tubing or narrow void chamber. In this example, the receptacle 102 may then be internal to the single-use bag 200. FIG. 13B is a cross-section view of a single-use bag 200 that may contain polyethylene 1112, EVOH 1114, polyamide 1116, and PET 1118 film layers. Additionally the single-use bag 200 may contain a barrier layer 1104 and internally formed receptacle 102 and duct 104 exemplarily configured as in FIG. 13A. FIG. 13C is a cross-section view of a single-use bag 200 that may contain first EVAM 1130, EVOH 1132, and second EVAM 1134 film layers. Additionally the single-use bag 200 may contain a barrier layer 1104 and internally formed receptacle 102 and duct 104 exemplarily configured as in FIG. 13A. FIG. 13D is a cross-section view of a single-use bag 200 that may contain first LLDPE 1144, EVOH 1146, and second LLDPE 1148 film layers. Additionally the single-use bag 200 may contain a barrier layer 1104 and internally formed receptacle 102 and duct 104 exemplarily configured as in FIG. 13A.

In another example, a tactile button device 100 may be removably attached to an external item such as a consumable component, a processing system and/or the arm of an operator. An attachment mechanism may include, but is not limited to, removable adhesives, strings and/or interlocking members. In an example, a single receptacle 102 or each receptacle 102 of a plurality of receptacles 152 may be singularly attached to the external item. In another example, the tactile button device 100 may comprise a plurality of receptacles 152 arranged onto a common substrate, so that by attaching the common substrate to the external item all of the plurality of receptacles 152 are provided at once on the external item. Additionally, the common substrate may at least partly hold together or bundle the ducts 104 of the plurality of receptacles, e.g. preventing entangling. The common substrate may be exemplarily fabricated from a flexible, light medium that may e.g. enable an operator to easily handle the tactile button device 100 and fittingly position it on a variety of different surfaces, such as curved or irregular surfaces. The common substrate may be, for example, in the form of a sheet, a sleeve, a jacket, a wrapper or other forms.

Figure 14B:
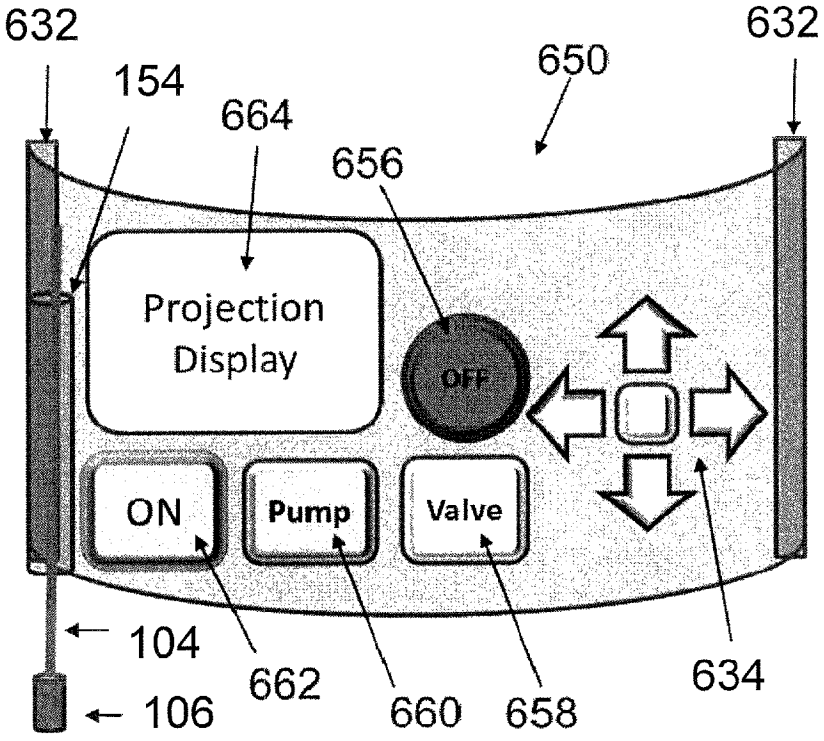
FIGS. 14A and 14B show examples of a tactile button device comprising a plurality of receptacles on a flexible jacket.
Figure 14A:
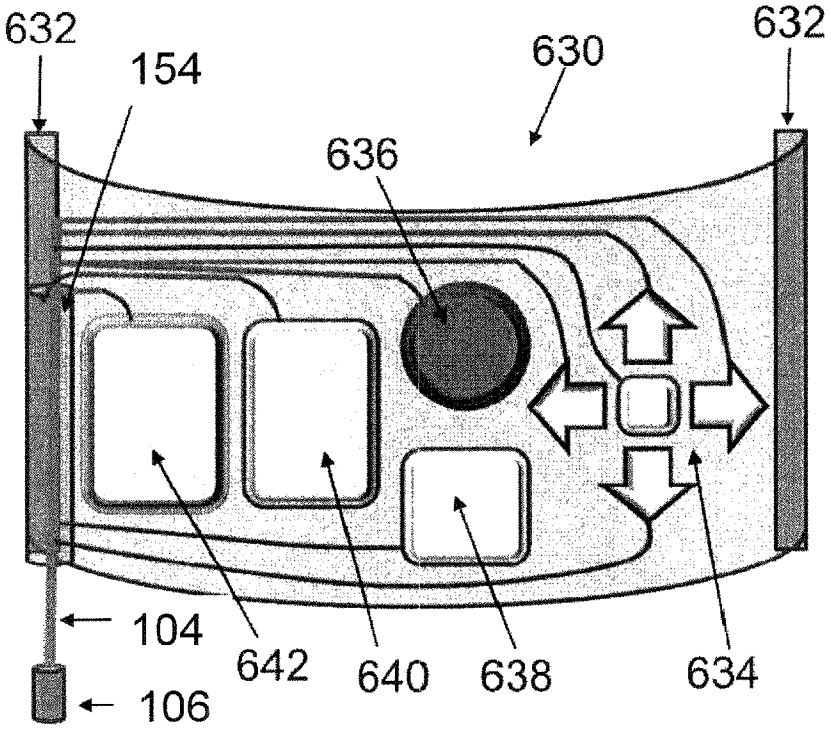

FIGS. 14A and 14B show examples of a tactile button device 100 comprising a plurality of receptacles on a flexible jacket. FIG. 14A a front view of a flexible jacket 630 that may be attached to a consumable component and/or a processing system using an attachment mechanism 632, e.g. elastic strings. The flexible jacket 630 may contain a plurality of receptacles 634, 636, 638, 640, 642 that may be utilized, for example, to activate/deactivate a process related function such as turning on a pump, opening a valve, initiating an integrity test, and so on. In an example, the flexible jacket 630 may be molded from a flexible film layer or a series of layered film layers. The plurality of receptacles 634, 636, 638, 640, 642 may be a series of small bags that have been integrated into the flexible jacket 630. Exemplarily, the plurality of receptacles may include a series of directional buttons with arrows 634, a round button 636 that may be colored red or filled with a red material to indicate stopping of a process function, a rectangular button 638 filled with air, a rectangular button 640 filled with a fluid in the off state, and a rectangular button 642 filled with a fluid in the on state, which is indicated by a lighted LED light. The plurality of receptacles 634, 636, 638, 640, 642 may be connected via a network of ducts 104 from each of the receptacles and utilize a common conduit assembly 154 to bring together all of the ducts 104. FIG. 14B shows another example of a flexible jacket 650. Some aspects already described with reference to FIG. 14A will not be further discussed. In this example, the plurality of receptacles may include a round button 656 colored red or filled with a red fluid and labeled "OFF" to indicate stopping a process function, a rectangular button 658 filled with air and labeled "Valve" to control the function of a valve, a rectangular button 660 filled with a fluid in the off state and labeled "Pump" to control the function of a pump, and a rectangular button 662 filled with a fluid and labeled "ON" filled with a fluid in the on state and is indicated by a lighted LED light. The plurality of receptacles 634, 656, 658, 660, 662 may be connected via a network of ducts 104 that may be obscured from view utilizing an opaque film layer. The flexible jacket 650 may also contain an area for a display device for an operator to visualize the functions selected on the processing devices and/or provide related information to the operator. In an example, the display device may be a projection display 664 that is a reflective surface where the operator may view the information originating from a nearby projector. In other examples, the display device may be, but is not limited to, an electronic ink, LCD, LED, OLED or plasma display.

Figure 15C:
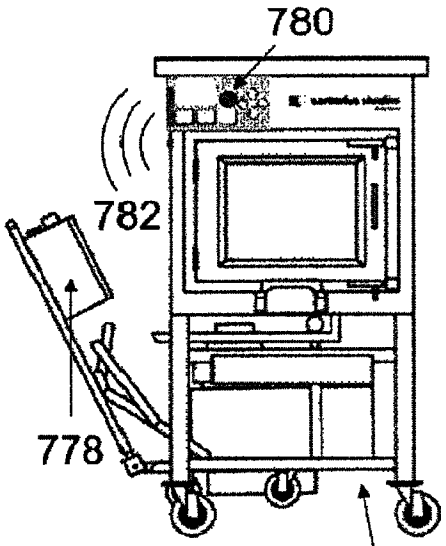
FIGS. 15A to 15E show examples of a tactile button device for controlling process devices.
Figure 15E:
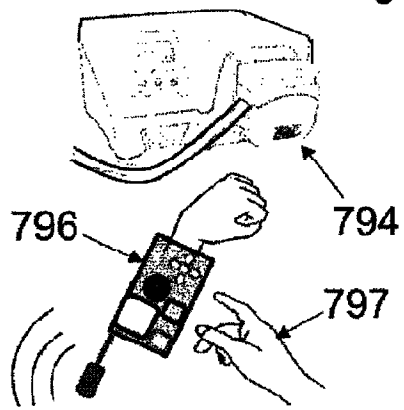
Figure 15B:
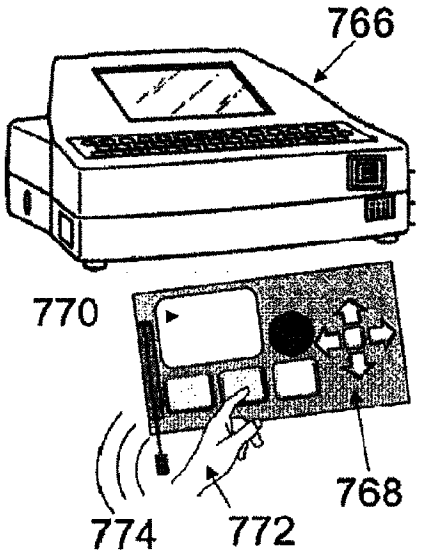
Figure 15A:
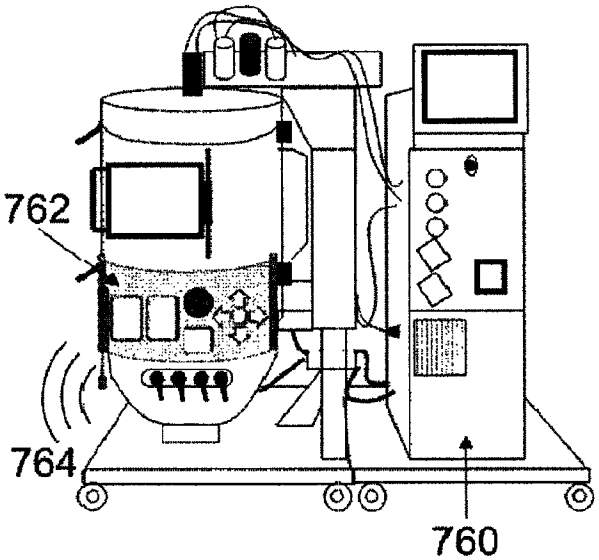
Figure 15D:
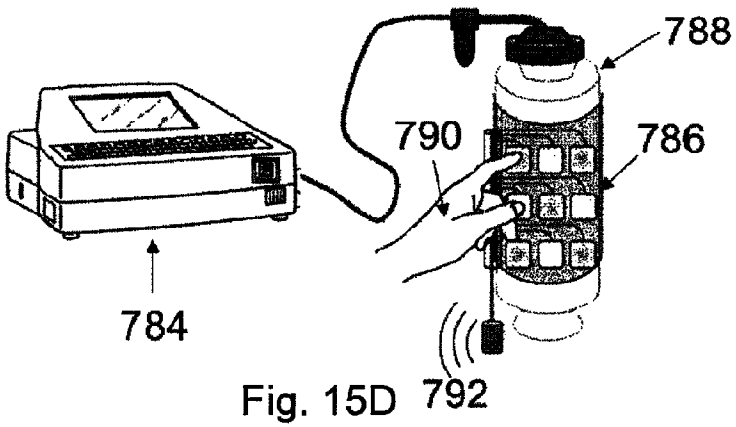

Exemplarily, a tactile button device 100 comprising a flexible jacket as shown in FIGS. 14A and 14B may be removably attached to process devices. FIGS. 15A-15E show examples of a tactile button device 100 for controlling process devices. FIG. 15A shows a front view of a Biostat® Cultibag® STR processing system 760 with a flexible jacket 762. The flexible jacket 762 with a tactile button device 100 may be attached to the body of the Biostat® Cultibag® STR processing system 760 using an attachment mechanism. The flexible jacket 762 may contain a plurality of receptacles that may be utilized to activate/deactivate processes of the Biostat® Cultibag® STR processing system 760 and related systems. In an example, when a receptacle is pressed, the flexible jacket 762 may send, via a communication device 876 connected to the connector 106 of the tactile button device 100, a wired or wireless signal 764 to the Biostat® Cultibag® STR processing system 760 to perform a function. FIG. 15B shows a front view of a Sartocheck® integrity testing processing system 766. A flexible jacket 768 with a tactile button device 100 may be located in front of the Sartocheck® integrity testing processing system 766 on a surface. The flexible jacket 768 may contain a plurality of receptacles that may be utilized to activate/deactivate processes of the Sartocheck® integrity testing processing system 766 and related systems. In an example, when a receptacle is pressed by an operator 772 the flexible jacket 768 may send, via a communication device 876 connected to the connector 106 of the tactile button device 100, a wired or wireless signal 774 to the Sartocheck® integrity testing processing system 766 to perform a function. FIG. 15C shows a front view of a Palletank® Mixing processing system 776 with a Mixing device 778. The flexible jacket 780 with a tactile button device 100 may be attached to the Palletank® Mixing processing system 776 using an attachment mechanism. The flexible jacket 780 may contain a plurality of receptacles that may be utilized to activate/deactivate processes of the Palletank® Mixing processing system 776, the Mixing device 778, and related systems. In an example, when a receptacle is pressed by an operator, the flexible jacket 780 may send, via a communication device 876 connected to the connector 106 of the tactile button device 100, a wired or wireless signal 782 to the Palletank® Mixing processing system 776 and/or the Mixing device 778 to perform a function. FIG. 15D shows a front view of a Sartocheck® integrity testing processing system 784. A flexible jacket 786 with a tactile button device 100 is attached to a filter capsule 788 that is connected to the Sartocheck® integrity testing processing system 784 via a tubing line. The flexible jacket 786 may contain a plurality of receptacles that may be utilized to activate/deactivate processes of the Sartocheck® integrity testing processing system 784 and related systems, such as programming and/or initiating an integrity test of the filter. In an example, when a receptacle is pressed by an operator 790, the flexible jacket 786 may send, via a communication device 876 connected to the connector 106 of the tactile button device 100, a wired or wireless signal 792 to the Sartocheck® integrity testing processing system 784 to perform a function. FIG. 15E shows a front view of a pump processing device 794. A flexible jacket 796 with a tactile button device 100 may be, for example, attached to an operator as a wearable device. The flexible jacket 796 may contain a plurality of receptacles that may be utilized to activate/deactivate processes of the pump processing device 794 and related systems. In an example, when a tactile button is pressed by an operator 797 the flexible jacket 796 may send, via a communication device 876 connected to the connector 106 of the tactile button device 100, a wired and/or wireless signal 798 to the pump processing device 794 to perform a function.

What is claimed is:

1. A tactile button device (100) suitable to be sterilized, the tactile button device (100) comprising:

at least one receptacle (102) that is adapted to be at least partly filled with a material (108) and being configured such that the material (108) filled into the receptacle (102) is at least partly displaced when subjected to a pressure, at least one duct (104) connected to the receptacle (102) and allowing the pressure exerted to the material (108) to be transmitted, a connector (106) connected to the at least one duct (104) and connectable to a detection device (500), such that the pressure on the material (108) is transmitted to the detection device (500).

2. The tactile button device (100) according to claim 1, wherein the at least one receptacle (102) is configured to be sterilized before it is connected to the detection device (500) via the connector (106).

3. The tactile button device (100) according to claim 1, wherein the material (108) comprises at least one of a fluid and a granular material.

4. The tactile button device (100) according to claim 1, wherein the connector (106) is part of a connector assembly (862) that further comprises:

a mating connector (860), which is separated from the connector (106) and is connected to the detection device (500), and wherein the connector (106) and the mating connector (860) are configured to be removably attached to each other.

5. The tactile button device (100) according to claim 1, wherein the tactile button device (100) is configured to be attached to an external item.

6. The tactile button device (100) according to claim 5, wherein the at least one receptacle (102) is attached to the external item with a heat based treatment method.

7. The tactile button device (100) according to claim 5, wherein the tactile button device is removably attached by means of an attachment device.

8. The tactile button device (100) according to claim 5, wherein the at least one receptacle (102) is configured such that it visually provides information about a state of the external item to an operator, wherein the state comprises at least one of non-usable, sterile or biohazard contaminated.

9. The tactile button device (100) according to claim 8, wherein a plurality of receptacles (552, 554, 556) in different shapes is provided and each receptacle is configured to be selectively filled with the material (108) depending on the state of the external item.

10. The tactile button device (100) according to claim 1, wherein the at least one receptacle (102) is identified by a label.

11. The tactile button device (100) according to claim 10, wherein the label (204) is at least one of a static label attached to the at least one receptacle (102) with an adhesive, a static label printed onto the at least one receptacle (102) and a static label laser labeled onto the at least one receptacle (102).

12. The tactile button device (100) according to claim 10, wherein the label is a display device (354; 358; 362; 366; 370) attached to the at least one receptacle (102).

13. The tactile button device (100) according to claim 1, wherein the at least one receptacle (102) is adapted to modify its configuration.

14. The tactile button device (100) according to claim 13, wherein the configuration is modified by means of at least one of a mask (1234), a series of movable frames (1202, 1204, 1206, 1208) and a series of strings (1214, 1216, 1218, 1220) that partially cover the receptacle (102) prior to inflation with the material (108).

15. A tactile button assembly (300) comprising:

the tactile button device (100) according to claim 1, a mating connector (860) connected to the connector (106) of the tactile button device (106), the detection device (500) connected to the tactile button device (100) via the mating connector (860), wherein the detection device (500) is configured to detect the transmitted pressure on the material (108) in the at least one filled receptacle (102).

16. The tactile button assembly (300) according to claim 15, wherein the detection device (500) utilizes at least one of an electric, mechanical, and electro-mechanical method to detect the transmitted pressure.

17. The tactile button assembly (300) according to claim 16, wherein the detection device (500) utilizes at least one of a pressure sensor (810), pressure transducer (822), pressure gauge (834, 836, 838), and gating mechanism (802) to detect the transmitted pressure.

18. The tactile button assembly (300) according to claim 15, wherein the detection device (500) is configured to detect a pressing pattern according to which the pressure on the at least one receptacle (102) is exerted, wherein the pressing pattern is chosen from at least one of a single press, a double-press, a long press, and a series of presses.

19. The tactile button assembly (300) according to claim 15, further comprising a processing and communication assembly (866), wherein the pressure exerted on the at least one receptacle (102) is configured to trigger at least one action on at least one of a mobile device, a wearable device, an augmented reality device, and other device linked to the communication assembly (866).

20. The tactile button assembly (300) according to claim 19, wherein the at least one action is configured to be programmed by an operator.

21. The tactile button assembly (300) according to claim 15, wherein the detection device (500) is hardened to withstand sterilization techniques and is configured to be sterilized together with the tactile button device (100).

22. A single-use product suitable to be sterilized, the single-use product comprising:

the tactile button device (100) according to claim 1, and a consumable component (200), wherein the tactile button device (100) is attached to the consumable component (200).

23. A single-use product suitable to be sterilized, the single-use product comprising:

the tactile button device (100) according to claim 1, and a consumable component (200), wherein the tactile button device (100) is integrally formed into the consumable component (200).

* * * * *